US005105973A

United States Patent [19]

Jentzsch et al.

[11] Patent Number: 5,105,973

[45] Date of Patent: Apr. 21, 1992

[54] BEVERAGE CONTAINER WITH IMPROVED BOTTOM STRENGTH

[75] Inventors: K. Reed Jentzsch, Arvada; Otis H. Willoughby, Boulder, both of Colo.

[73] Assignee: Ball Corporation, Muncie, Ind.

[21] Appl. No.: 600,943

[22] Filed: Oct. 22, 1990

[51] Int. Cl.[5] ..... B65D 7/42

[52] U.S. Cl. ..... 220/606; 220/906

[58] Field of Search ..... 220/606, 604, 608, 609, 220/623, 624, 906

[56] References Cited

U.S. PATENT DOCUMENTS

| | | | |
|---|---|---|---|
| 994,468 | 6/1911 | Kane | 220/604 X |
| 1,031,264 | 7/1912 | Hinde et al. | 220/604 |
| 1,441,674 | 1/1923 | Foster et al. | 220/604 |
| 1,461,729 | 7/1923 | Foster et al. | 220/604 X |
| 3,905,507 | 9/1975 | Lyu | 220/608 |
| 4,108,324 | 8/1978 | Krishnakumar et al. | 220/608 X |
| 4,120,419 | 10/1978 | Saunders | 220/609 |
| 4,151,927 | 5/1979 | Cvacho et al. | 220/606 |
| 4,412,627 | 11/1983 | Houghton et al. | 220/906 X |
| 4,515,284 | 5/1985 | Lee, Jr. et al. | 220/606 |
| 4,598,831 | 7/1986 | Nakamura et al. | 220/606 X |
| 4,685,582 | 8/1987 | Pulciani et al. | 220/606 |
| 4,732,292 | 3/1988 | Supik | 220/906 X |
| 4,834,256 | 5/1989 | McMillin | 220/606 |
| 4,919,294 | 4/1990 | Kawamoto et al. | 220/606 |
| 4,953,738 | 9/1990 | Stirbis | 220/906 X |

*Primary Examiner*—Steven M. Pollard
*Attorney, Agent, or Firm*—Gilbert E. Alberding

[57] ABSTRACT

A container with improved strength includes a cylindrical sidewall that is disposed around a vertical axis, and a bottom. The bottom of the container provides a supporting surface and includes a bottom recess portion that is disposed radially inwardly of the supporting surface. The bottom recess portion includes a center panel, and a dome positioning portion that positions the center panel above the supporting surface. The dome positioning portion includes a first part that is disposed at a first radial distance from the vertical axis and adjacent part that is disposed at a different radial distance from the vertical axis. In the container, a plurality of the adjacent parts are arcuately disposed are circumferentially spaced around the dome positioning portion and are interspersed with a plurality of the first parts. In the container the adjacent part is disposed circumferentially around the dome positioning portion at one height from the supporting surface, and the first part is disposed circumferentially around the dome positioning portion at a different height from the supporting surface.

19 Claims, 7 Drawing Sheets

BEVERAGE CONTAINER WITH IMPROVED BOTTOM STRENGTH

BACKGROUND OF THE INVENTION

1. Field of the Invention

The present invention relates generally to metal container bodies of the type having a seamless sidewall and a bottom formed integrally therewith. More particularly, the present invention relates to a bottom contour that provides increased dome reversal pressure, that provides greater resistance to damage when dropped, and that minimizes or prevents growth in the height of a container in which the beverage is subjected to pasteurizing temperatures and/or extreme temperatures encountered in shipping and storage.

2. Description of the Related Art

There have been numerous container configurations of two-piece containers, that is, containers having a body that has an integral bottom wall at one end, and an opposite end that is configured to have a closure secured thereto. Container manufacturers package beverages of various types in these containers formed of either steel or aluminum alloys.

In the production of these containers, it is important that the body wall and bottom wall of the container be as thin as possible so that the container can be sold at a competitive price. Much work has been done on thinning the body wall.

Aside from seeking thin body wall structures, various bottom wall configurations have been investigated. An early attempt in seeking sufficient strength of the bottom wall was to form the same into a spherical dome configuration. This general configuration is shown in Dunn et al., U.S. Pat. No. 3,760,751, issued Sep. 25, 1973. The bottom wall is thereby provided with an inwardly concave dome or bottom recess portion which includes a large portion of the area of the bottom wall of the container. This domed configuration provides increased strength and resists deformation of the bottom wall under increased internal pressure of the container with little change in the overall geometry of the bottom wall throughout the pressure range for which the container is designed.

The prior art that teaches domed bottoms also includes P. G. Stephan, U.S. Pat. No. 3,349,956, issued Oct. 31, 1967; Kneusel et al., U.S. Pat. No. 3,693,828, issued Sep. 26, 1972; Dunn et al., U.S. Pat. No. 3,730,383, issued May 1, 1973; Toukmanian, U.S. Pat. No. 3,904,069, issued Sep. 9, 1975; Lyu et al., U.S. Pat. No. 3,942,673, issued Mar. 9, 1976; Miller et al., U.S. Pat. No. 4,294,373, issued Oct. 13, 1981; McMillin, U.S. Pat. No. 4,834,256, issued May 30, 1989; Pulciani et al., U.S. Pat. No. 4,685,582, issued Aug. 11, 1987, and Pulciani, et al., U.S. Pat. No. 4,768,672, issued Sep. 6, 1988, and Kawamoto et al., issued Apr. 24, 1990.

Patents which teach apparatus for forming containers with inwardly domed bottoms and/or which teach containers having inwardly domed bottoms, include Maeder et al., U.S. Pat. No. 4,289,014, issued Sep. 15, 1981; Gombas, U.S. Pat. No. 4,341,321, issued Jul. 27, 1982; Elert et al., U.S. Pat. No. 4,372,143, issued Feb. 8, 1983; and Pulciani et al., U.S. Pat. No. 4,620,434, issued Nov. 4, 1986.

Of the above-mentioned patents, Lyu et al. and Kawamoto et al. teach inwardly domed bottoms in which the shape of the inwardly domed bottom is ellipsoidal.

Stephan, in U.S. Pat. No. 3,349,956, teaches using a reduced diameter annular supporting portion with an inwardly domed bottom disposed intermediate of the reduced diameter annular supporting portion. Stephan also teaches stacking of the reduced diameter annular supporting portion inside the double-seamed top of another container.

Kneusel et al., in U.S. Pat. No. 3,693,828, teach a steel container having a bottom portion which is frustoconically shaped to provide a reduced diameter annular supporting portion, and having an internally domed bottom that is disposed radially inwardly of the annular supporting portion. Various contours of the bottom are adjusted to provide more uniform coating of the interior bottom surface, including a reduced radius of the domed bottom.

Pulciani et al., in U.S. Pat. Nos. 4,685,582 and 4,768,672, instead of the frustoconical portion of Kneusel et al., teach a transition portion between the cylindrically shaped body of the container and the reduced diameter annular supporting portion that includes a first annular arcuate portion that is convex with respect to the outside diameter of the container and a second annular arcuate portion that is convex with respect to the outside diameter of the container.

McMillin, in U.S. Pat. No. 4,834,256, teaches a transitional portion between the cylindrically shaped body of the container and the reduced diameter annular supporting portion that is contoured to provide stable stacking for containers having a double-seamed top which is generally the same diameter as the cylindrical body, as well as providing stable stacking for containers having a double-seamed top that is smaller than the cylindrical body. In this design, containers with reduced diameter tops stack inside the reduced diameter annular supporting portion; and containers with larger tops stack against this specially contoured transitional portion.

Supik, in U.S. Pat. No. 4,732,292, issued Mar. 22, 1988, teaches making indentions in the bottom of a container that extend upwardly from the bottom. Various configurations of these indentations are shown. The indentations are said to increase the flexibility of the bottom and thereby prevent cracking of interior coatings when the containers are subjected to internal fluid pressures.

In U.S. Pat. No. 4,885,924, issued Dec. 12, 1989, which was disclosed in W.I.P.O. International Publication No. WO 83/02577 of Aug. 4, 1983, Claydon et al. teach apparatus for rolling the outer surface of the annular supporting portion radially inward, thereby reducing the radii of the annular supporting portion. This rolling of the annular supporting portion inwardly to prevent inversion of the dome when the container is subjected to internal fluid pressures.

Various of the prior art patents, including Pulciani et al., U.S. Pat. No. 4,620,434, teach contours which are designed to increase the pressure at which fluid inside the container reverses the dome at the bottom of the container. This pressure is called the static dome reversal pressure. In this patent, the contour of the transitional portion is given such great emphasis that the radius of the domed panel, though generally specified within a range, is not specified for the preferred embodiment.

However, it has been known that maximum values of static dome reversal pressure are achieved by increasing the curvature of the dome to an optimum value, and that further increases in the dome curvature result in decreases in static dome reversal pressures.

As mentioned earlier, one of the problems is obtaining a maximum dome reversal pressure for a given metal thickness. However, another problem is obtaining resistance to damage when a filled container is dropped onto a hard surface.

Present industry testing for drop resistance is called the cumulative drop height. In this test, a filled container is dropped onto a steel plate from heights beginning at three inches and increasing by three inches for each successive drop. The drop height resistance is then the sum of all the distances at which the container is dropped, including the height at which the dome is reversed, or partially reversed. That is, the drop height resistance is the cumulative height at which the bottom contour is damaged sufficiently to preclude standing firmly upright on a flat surface.

In U.S. patent application Ser. No. 07/505,618 having common inventorship entity, and being of the same assignee as the present application, it was shown that decreasing the dome radius of the container increases the cumulative drop height resistance and decreases the dome reversal pressure. Further, it was shown in this prior application that increasing the height of the inner wall increases the dome reversal pressure.

However, as the dome radius is decreased for a given dome height, the inner wall decreases in height. Therefore, for a given dome height, an increase in cumulate drop resistance, as achieved by a decrease in dome radius, results in a decrease in the height of the inner wall together with an attendant decrease in the dome reversal pressure.

Thus, one way to achieve a good combination of cumulative drop height and dome reversal pressure, is to increase the dome height, thereby allowing a reduction in dome radius while leaving an adequate wall height. However, there are limits to which the dome height can be increased while still maintaining standard diameter, height, and volume specifications.

An additional problem in beverage container design and manufacturing has been in maintaining containers within specifications, subsequent to a pasteurizing process, when filled beverage containers are stored at high ambient temperatures, and/or when they are exposed to sunlight.

This increase in height is caused by roll-out of the annular supporting portion as the internal fluid pressure on the domed portion applies a downward force to the circumferential inner wall, and the circumferential inner wall applies a downward force on the annular supporting portion.

An increase in the height of a beverage container causes jamming of the containers in filling and conveying equipment, and unevenness in stacking.

As is known, a large quantity of containers are manufactured annually and the producers thereof are always seeking to reduce the amount of metal utilized in making containers while still maintaining the same operating characteristics.

Because of the large quantities of containers manufactured, a small reduction in metal thickness, even of one-half of one thousandth of an inch, will result in a substantial reduction in material costs.

SUMMARY OF THE INVENTION

According to the present invention, the dome reversal pressure of a drawn and ironed beverage container is increased without increasing the metal thickness, increasing the height of an inner wall that surrounds the domed portion, increasing the total dome height, or decreasing the dome radius.

Further, in the present invention, both increased resistance to roll-out of the annular supporting portion and increased cumulative drop height resistance are achieved without any increase in metal content, and without any changes in the general size or shape of the container.

A container which provides increased resistance to roll-out, increased dome reversal pressure, and increased cumulative drop height resistance includes a cylindrical outer wall that is disposed around a vertical axis, a bottom that is attached to the outer wall and that provides a supporting surface, and a bottom recess portion that is disposed radially inwardly of the supporting surface, that includes a center panel, or concave domed panel, and that includes a circumferential dome positioning portion that disposes the center panel a positional distance above the supporting surface.

In one embodiment of the present invention, the bottom recess portion includes a part thereof that is disposed at a first vertical distance above the supporting surface and at a first radial distance from the vertical axis; and the bottom recess portion also includes an adjacent part that is disposed at a greater vertical distance above the supporting surface and at a greater radial distance from the vertical axis than the first part.

That is, the bottom recess portion includes an adjacent part that extends radially outward from a first part that is closer to the supporting surface. In this configuration, this adjacent part extends circumferentially around the container, thereby providing an annular radial recess that hooks outwardly of the part of the bottom recess that is closer to the supporting surface.

In another embodiment of the present invention, the adjacent part is arcuate and extends for only a portion of the circumference of the bottom recess portion. Preferably a plurality of adjacent parts, and more preferably five adjacent parts, extend radially outward from a plurality of the first parts, and are interposed between respective ones of the first parts.

Generally speaking, in the present invention, a plurality of strengthening parts are disposed in the circular inner wall of the bottom recess portion, and either extend circumferentially around the bottom recess portion or are circumferentially spaced. The strengthening parts project either radially outwardly or radially inwardly with respect to the circular inner wall.

The strengthening parts may be contained entirely within the inner wall, may extend downwardly into the annual supporting surface, portion, may extend upwardly into the concave annular portion that surrounds the domed portion, and/or may extend upwardly into both the concave annular portion and the concave domed panel.

The strengthening parts may be round, elongated vertically, may be elongated circumferentially, and/or may be elongated at an angle between vertical and circumferential.

In summary, the present invention provides a container with improved static dome reversal pressure without any increase in material, and without any change in dimensions that affects interchangeability of filling and/or packaging machinery.

Further, the present invention provides a container with enhanced resistance to pressure-caused roll-out and the resultant change in the overall height of the container that accompanies fluid pressures encountered during the pasteurizing process.

Finally, the present invention provides a container with improved cumulative drop height resistance without any increase in material, and without any changes in dimensions that affect interchangeability of filling machinery, thereby making possible a reduction of, or elimination of, cushioning that has been provided by carton and case packaging.

In a first aspect of the present invention, a container with improved strength includes an outer wall being disposed around a vertical axis; a bottom being attached to the outer wall and having a supporting surface; a bottom recess portion of the bottom being disposed radially inwardly of the supporting surface, having a dome positioning portion that connects the bottom recess portion to the remainder of the bottom, and having a center panel that is disposed above the supporting surface by the dome positioning portion; and means for increasing the roll-out resistance of the bottom recess portion.

In a second aspect of the present invention, a method for strengthening the bottom of a container that includes an outer wall that is disposed around a vertical axis, and a bottom that is integral with the outer wall and that includes a supporting surface, includes forming a bottom recess portion in the bottom that includes a dome positioning portion with a convex annular portion that connects the bottom recess portion to the remainder of the bottom, and that includes a center panel that is disposed above the supporting surface by the dome positioning portion; and increasing the roll-out resistance of the convex annular portion.

In a third aspect of the present invention, a container with increased strength includes an outer wall that is disposed around a vertical axis, a bottom that is attached to the outer wall and that provides a supporting surface, and a bottom recess portion that is disposed radially inwardly of the supporting surface and that includes a center panel, the bottom recess portion including a first part that is disposed at a first vertical distance above the supporting surface and at a first radial distance from the vertical axis; and the bottom recess portion including an adjacent part that is disposed at a greater vertical distance above the supporting surface and at a greater radial distance from the vertical axis than the first part.

In one variation of this third aspect, the adjacent part is substantially circumferential; and in another variation of the third aspect, the adjacent part extends less than 180 degrees around the bottom recess portion.

In a fourth aspect of the present invention, a container with increased resistance strength includes an outer wall that is disposed around a vertical axis, a bottom that is attached to the outer wall and that provides a supporting surface, and a bottom recess portion that is disposed radially inwardly of the supporting surface, and that includes a center panel, the bottom recess portion including a first part that is disposed at a first vertical distance above the supporting surface and at a first radial distance from the vertical axis; and the bottom recess portion including an adjacent part that is disposed at the first vertical distance above the supporting surface and at a greater radial distance from the vertical axis than the first part.

In a fifth aspect of the present invention, a container with increased strength includes an outer wall that is disposed around a vertical axis, a bottom that is attached to the outer wall and that provides a supporting surface, and a bottom recess portion that is disposed radially inwardly of the supporting surface and that includes a center panel, the improvement which comprises the bottom recess portion including a first part that is disposed substantially circumferentially around the bottom recess portion at a first vertical distance above the supporting surface, and that is disposed at a first radial distance from the vertical axis; and the bottom recess portion including an adjacent part that is disposed substantially around the bottom recess portion at a greater vertical distance above the supporting surface and that is disposed at a different radial distance from the vertical axis than the first part.

In a sixth aspect of the present invention, a container with increased strength includes an outer wall that is disposed around a vertical axis; a bottom that is attached to the outer wall and that provides a supporting surface; a bottom recess portion that is disposed radially inwardly of the supporting surface and that includes a center panel; and means comprising a reworked part of the bottom recess portion, for increasing the roll-out strength of the container.

In variations of this sixth aspect, the reworked part may be a cold working without appreciable deformation of metal, or it may include any and all of the characteristics of the adjacent part as described in the third, fourth, and fifth aspects.

In a seventh aspect of the present invention, a method is provided for increasing strength of a container which includes an outer wall that is disposed around a vertical axis, a bottom that is attached to the outer wall and that provides a supporting surface, and a bottom recess portion that is disposed radially inwardly of the supporting surface and that includes a center panel, which method includes forming the bottom recess portion with a first part that is disposed at a first vertical distance above the supporting surface and at a first radial distance from the vertical axis; and forming the bottom recess portion with an adjacent part that is disposed at a greater vertical distance above the supporting surface and at a greater radial distance from the vertical axis than the first part.

In one variation of the seventh aspect, the second forming step includes extending the adjacent part substantially around the bottom recess portion; and in another variation of this seventh aspect, the second forming step includes forming the adjacent part less than 180 degrees around the bottom recess portion.

In an eight aspect of the present invention a method is provided for increasing the strength of a container which includes an outer wall that is disposed around a vertical axis, a bottom that is attached to the outer wall and that provides a supporting surface, and a bottom recess portion that is disposed radially inwardly of the supporting surface and that includes a center panel, which method includes forming the bottom recess portion with a first part that is disposed at a first vertical distance above the supporting surface and at a first radial distance from the vertical axis, and forming the bottom recess portion with an adjacent part that is disposed at the first vertical distance above the supporting surface and at a greater radial distance from the vertical axis than the first part.

In a ninth aspect of the present invention, a method is provided for increasing the strength of a container which includes an outer wall that is disposed around a vertical axis, a bottom that is attached to the outer wall and that provides a supporting surface, and a bottom recess portion that is disposed radially inwardly of the supporting surface and that includes a center panel, which method includes forming the bottom recess portion with a first part that is disposed substantially around the bottom recess portion at a first vertical distance above the supporting surface, and that is disposed at a first radial distance from the vertical axis; and forming the bottom recess portion with an adjacent part that is disposed substantially around the bottom recess portion at a second and greater vertical distance above the supporting surface, and that is disposed at a different radial distance from the vertical axis than the first part.

In a tenth aspect of the present invention, a method is provided for increasing the strength of a container which includes an outer wall that is disposed around a vertical axis, and a bottom that is attached to the outer wall and that provides a supporting surface, which method includes forming a bottom recess portion that is disposed radially inwardly of the supporting surface and that includes a center panel; and reworking a part of the bottom recess portion.

In an eleventh aspect of the present invention, a container with improved strength includes an outer wall being disposed around a vertical axis; a bottom being attached to the outer wall and having a supporting surface; a bottom recess portion of the bottom being disposed radially inwardly of the supporting surface, having a dome positioning portion with a convex annular portion that connects the bottom recess portion to the remainder of the bottom, and having a center domed panel that is disposed above the supporting surface by the dome positioning portion; and means for applying a roll-in force to the convex annular portion that is a function of fluid pressure applied internally to the center panel.

In a twelfth aspect of the present invention, a method is provided for strengthening a container that includes an outer wall that is disposed around a vertical axis, and a bottom that is integral with the cylindrical outer wall and that includes a supporting surface, which method includes forming a bottom recess portion in the bottom that includes a dome positioning portion with a convex annular portion that connects the bottom recess portion to the remainder of the bottom, and that includes a center panel that is disposed above the supporting surface by the dome positioning portion; and providing a roll-in force on the convex annular portion that is a function of fluid pressure applied internally to the center panel.

In a thirteenth aspect of the present invention, a container with improved strength comprises an outer wall being disposed around a vertical axis; a bottom being attached to the outer wall, having an inner wall, and having a center panel that is disposed upwardly by the inner wall; and the inner wall including at least a part thereof that slopes outwardly and upwardly.

DESCRIPTION OF THE PREFERRED EMBODIMENTS

Figure 3:
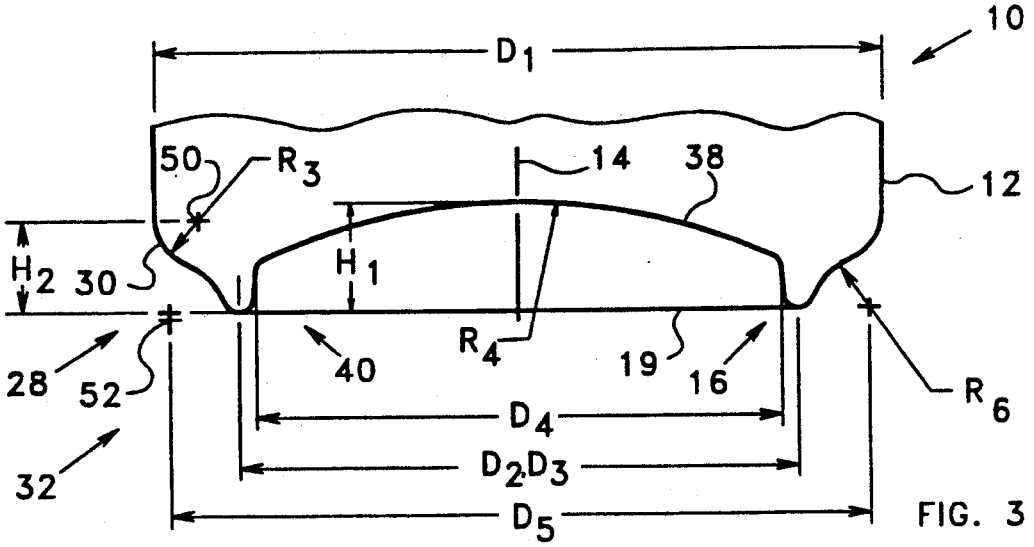
FIG. 3 is a cross sectional elevation of the lower portion of one of the beverage containers of FIGS. 1 and 2, showing details that are generally common to two prior art designs.
Figure 4:
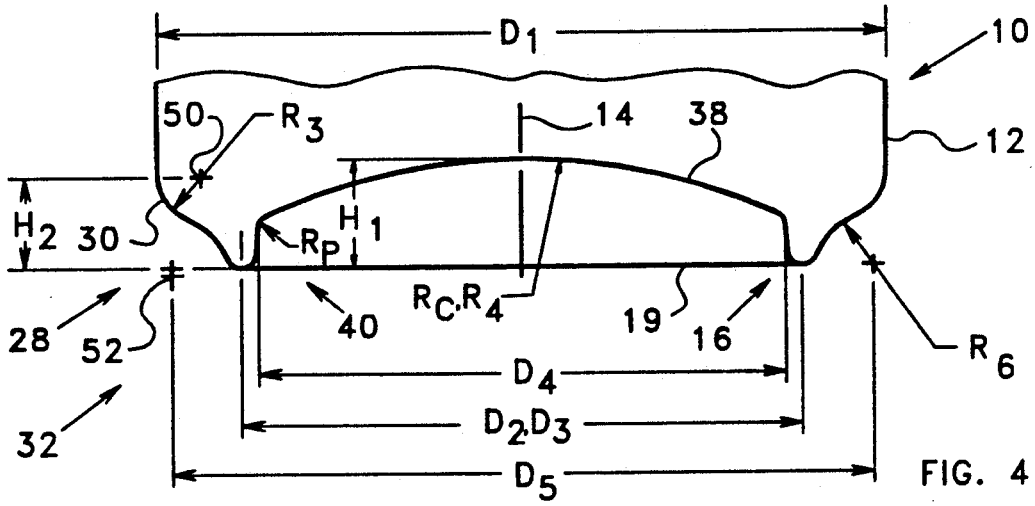
FIG. 4 is a cross sectional elevation of the lower portion of a beverage container, showing details that are generally common to those of FIG. 4, which, together with dimensions as provided herein, is used to describe a first embodiment of the present invention.
Figure 5:
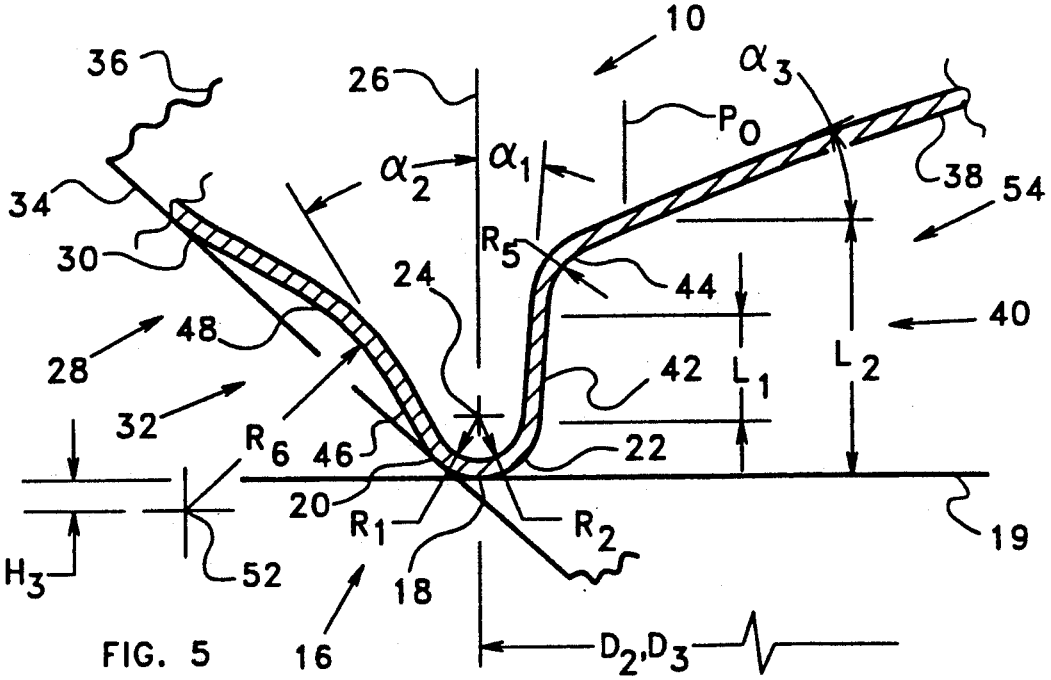
FIG. 5 is a cross sectional elevation, showing, at an enlarged scale, details that are generally common to both FIGS. 3 and 4.

Referring now to FIGS. 3, 4, and 5, these configurations are generally common to Pulciani et al. in U.S. Pat. Nos. 4,685,582 and 4,768,672, to a design manufactured by the assignee of the present invention, and to embodiments of the present invention. More particularly, FIG. 3 is common to the aforesaid prior art, FIG.

4 is common to two embodiments of the prior art, and FIG. 5 shows some details of FIGS. 3 and 4 in an enlarged scale.

Since the present invention differs from the prior art primarily by selection of some of the parameters shown in FIGS. 3-5, the forthcoming description refers to all of these drawings, except as stated otherwise; and some dimensions pertaining to FIGS. 3 and 4 are placed only on FIG. 5 in order to avoid crowding.

Continuing to refer to FIGS. 3-5, a drawn and ironed beverage container 10 includes a generally cylindrical sidewall 12 that includes a first diameter $D_1$, and that is disposed circumferentially around a vertical axis 14; and an annular supporting portion, or annular supporting means, 16 that is disposed circumferentially around the vertical axis 14, that is disposed radially inwardly from the sidewall 12, and that provides an annular supporting surface 18 that coincides with a base line 19.

The annular supporting portion 16 includes an outer convex annular portion 20 that preferably is arcuate, and an inner convex annular portion 22 that preferably is arcuate, that is disposed radially inwardly from the outer convex annular portion 20, and that is connected to the outer convex annular portion 20. The outer and inner convex annular portions, 20 and 22, have radii $R_1$ and $R_2$ whose centers of curvature are common. More particularly, the radii $R_1$ and $R_2$ both have centers of curvature of a point 24, and of a circle of revolution 26 of the point 24. The circle of revolution 26 has a second diameter $D_2$.

An outer connecting portion, or outer connecting means, 28 includes an upper convex annular portion 30 that is preferably arcuate, that includes a radius of $R_3$, and that is connected to the sidewall 12. The outer connecting portion 28 also includes a recessed annular portion 32 that is disposed radially inwardly of a line 34, or a frustoconical surface of revolution 36, that is tangent to the outer convex annular portion 20 and the upper convex annular portion 30. Thus, the outer connecting means 28 connects the sidewall 12 to the outer convex annular portion 20.

A center panel, or concave domed panel, 38 is preferably spherically-shaped, but may be of any suitable curved shape, has an approximate radius of curvature, or dome radius, $R_4$, is disposed radially inwardly from the annular supporting portion 16, and curves upwardly into the container 10. That is, the domed panel 38 curves upwardly proximal to the vertical axis 14 when the container 10 is in an upright position.

The container 10 further includes an inner connecting portion, or inner connecting means, 40 having a circumferential inner wall, or cylindrical inner wall, 42 with a height $L_1$ that extends upwardly with respect to the vertical axis 14 that may be cylindrical, or that may be frustoconical and slope inwardly toward the vertical axis 14 at an angle $\alpha_1$. The inner connecting portion 40 also includes an inner concave annular portion 44 that has a radius of curvature $R_5$, and that interconnects the inner wall 42 and the domed panel 38. Thus, the inner connecting portion 40 connects the domed panel 38 to the annular supporting portion 16.

The inner connecting portion 40 positions a perimeter $P_0$ of the domed panel 38 at a positional distance $L_2$ above the base line 19. As can be seen by inspection of FIG. 5, the positional distance $L_2$ is approximately equal to, but is somewhat less than, the sum of the height $L_1$ of the inner wall 42, the radius of curvature $R_5$ of the inner concave annular portion 44, the radius $R_2$ of the inner convex annular portion 22, and the thickness of the material at the inner convex annular portion 22.

As seen by inspection and as can be calculated by trigonometry, the positional distance $L_2$ is less than the aforementioned sum by a function of the angle $\alpha_1$, and as a function of an angle $\alpha_3$ at which the perimeter $P_0$ of the domed panel 38 is connected to the inner concave annular portion 44.

For example, if the radius $R_5$ of the inner concave annular portion 44 is 0.050 inches, if the radius $R_2$ of the inner convex annular portion 22 is 0.040 inches, and if the thickness of the material at the inner convex annular portion 22 is about 0.012 inches, then the positional distance $L_2$ is about, but somewhat less than, 0.102 inches more than the height $L_1$ of the inner wall 42.

Thus, with radii and metal thickness as noted above, when the height $L_1$ of the inner wall 42 is 0.060 inches, the positional distance $L_2$ is about, but a little less than, 0.162 inches.

The annular supporting portion 16 has an arithmetical mean diameter $D_3$ that occurs at the junction of the outer convex annular portion 20 and the inner convex annular portion 22. Thus, the mean diameter $D_3$ and the diameter $D_2$ of the circle 26 are the same diameter. The dome radius $R_4$ is centered on the vertical axis 14.

The recessed annular portion 32 includes a circumferential outer wall 46 that extends upwardly from the outer convex annular portion 20 and outwardly away from the vertical axis by an angle $\alpha_2$, and includes a lower concave annular portion 48 with a radius $R_6$. Further, the recessed annular portion 32 may, according to the selected magnitudes of the angle $\alpha_2$, the radius $R_3$, and the radius $R_6$, include a lower part of the upper convex annular portion 30.

Finally, the container 10 includes a dome height, or panel height, $H_1$ as measured from the supporting surface 18 to the domed panel 38, and a post diameter, or smaller diameter, $D_4$, of the inner wall 42. The upper convex annular portion 30 is tangent to the sidewall 12, and has a center 50. The center 50 is at a height $H_2$ above the supporting surface 18. A center 52 of the lower concave annular portion 48 is on a diameter $D_5$. The center 52 is below the supporting surface 18. More specifically, the supporting surface 18 is at a distance $H_3$ above the center 52.

Referring now to FIGS. 3 and 5, in the prior art embodiment of the three Pulciani, et al. patents, the following dimensions were used: $D_1=2.597$ inches; $D_2$, $D_3=2.000$ inches; $D_5=2.365$ inches; $R_1$, $R_2=0.040$ inches; $R_3=0.200$ inches; $R_4=2.375$ inches; $R_5=0.050$ inches; $R_6=0.100$ inches; and $\alpha_1$=less than $5^0$.

Figure 6:
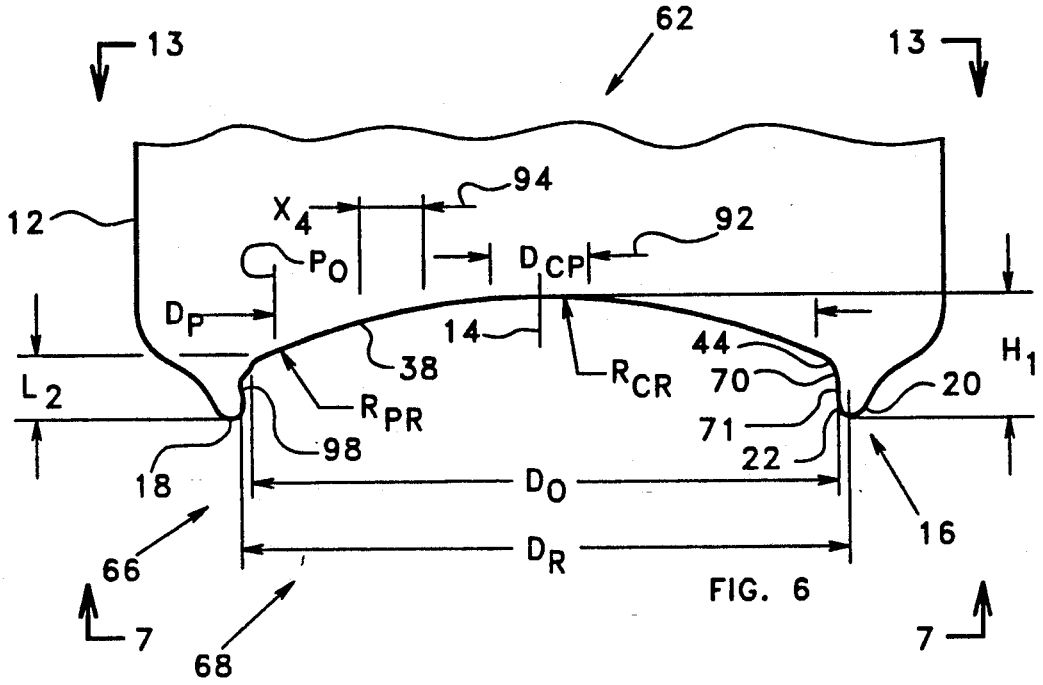
FIG. 6 is a slightly enlarged outline, taken generally as a cross sectional elevation, of the lower portion of the outer contour of a container of an embodiment of the present invention wherein a plurality of arcuately shaped and circumferentially spaced parts of the inner sidewall are disposed radially outward of other parts of the sidewall.
Figure 7:
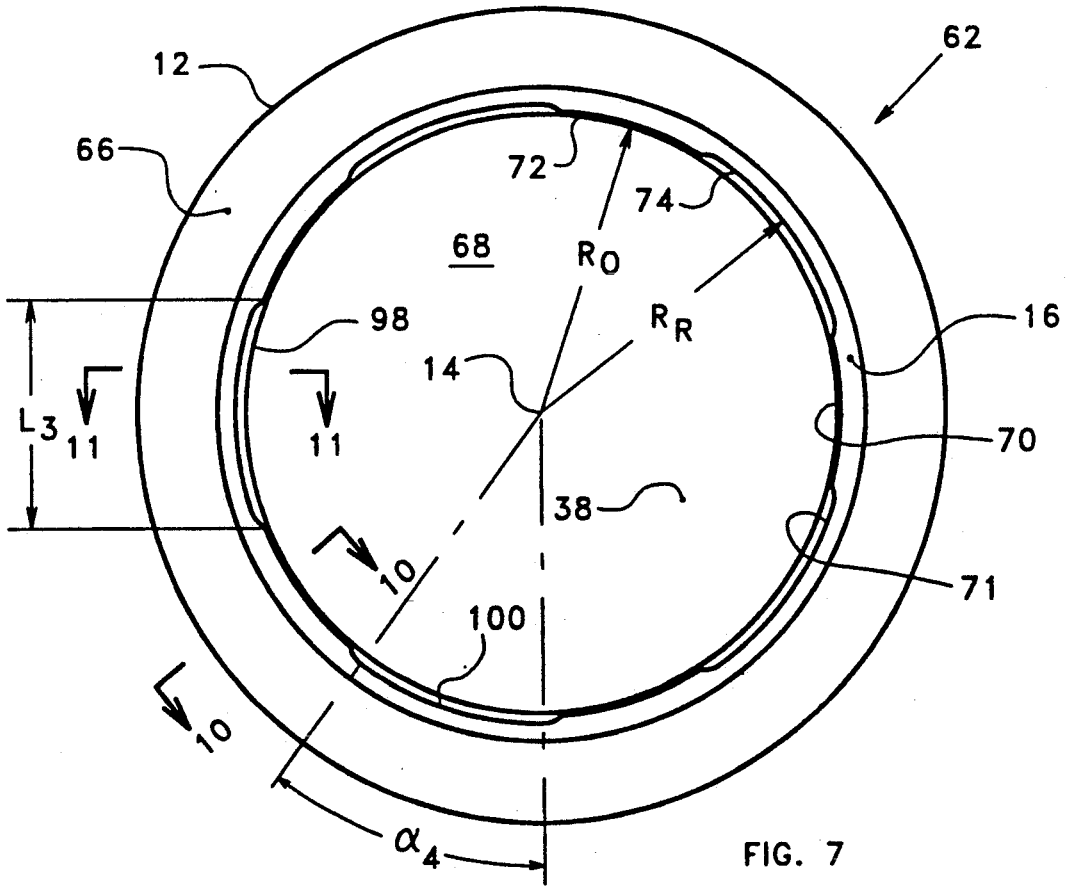
FIG. 7 is a bottom view of the container of FIG. 6, taken substantially as shown by view line 7—7 of FIG. 6.
Figure 8:
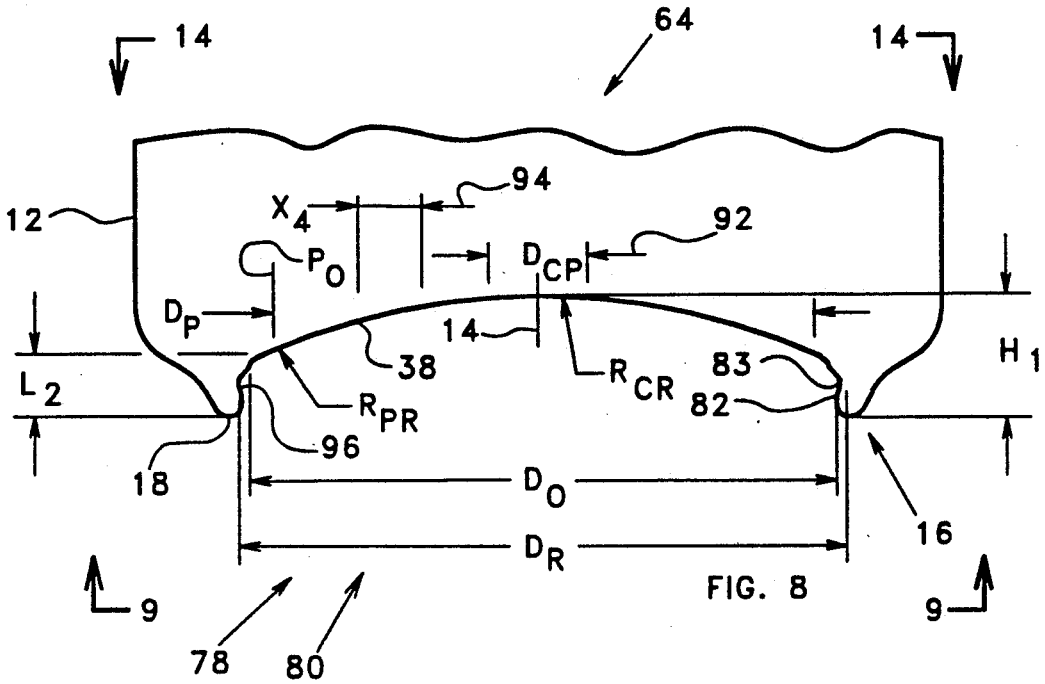
FIG. 8 is a slightly enlarged outline, taken generally as a cross sectional elevation, of the lower portion of the outer contour of a container made according to an embodiment of the present invention wherein a circumferential part of the inner sidewall is disposed radially outward of another circumferential part of the sidewall.
Figure 9:
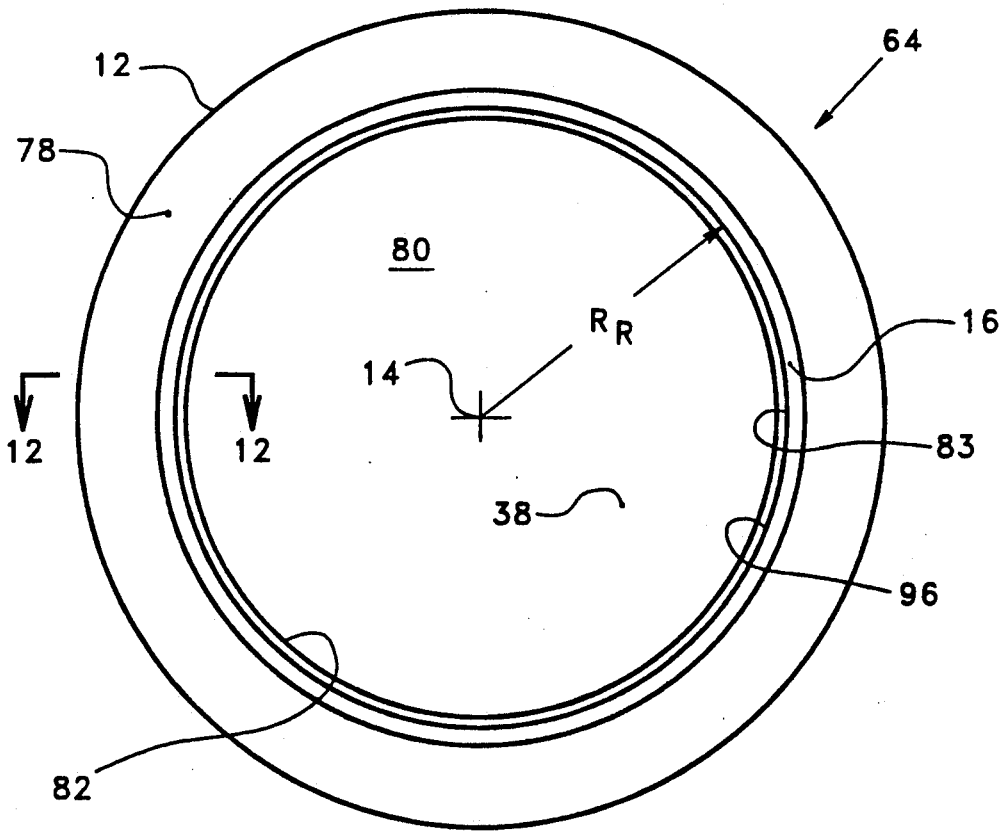
FIG. 9 is a bottom view of the container of FIG. 8, taken substantially as shown by view line 9—9 of FIG. 8.
Figure 10:
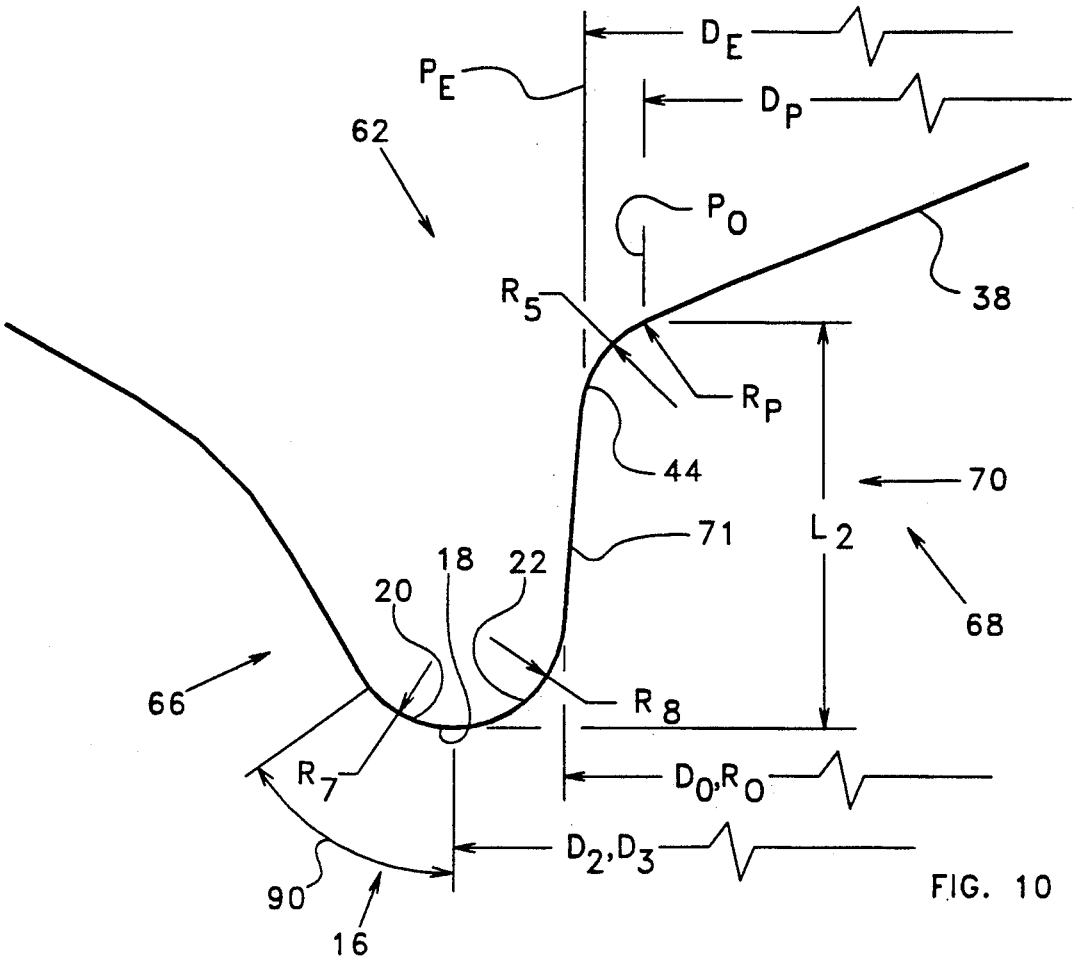
FIG. 10 is a fragmentary and greatly enlarged outline, taken generally as a cross sectional elevation, of the outer contour of the container of FIGS. 6 and 7, taken substantially as shown by section line 10—10 of FIG. 7.
Figure 11:
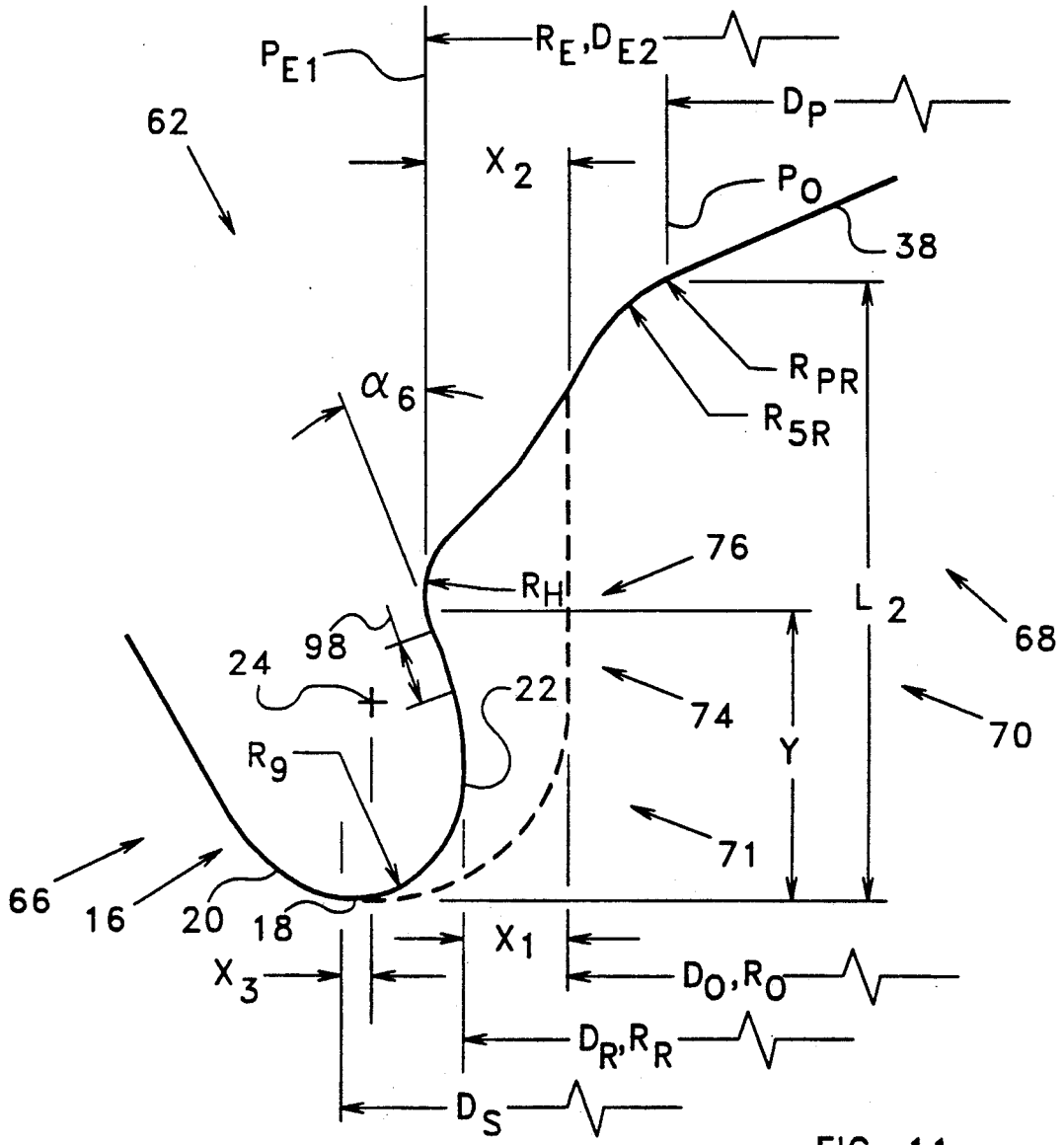
FIG. 11 is a fragmentary and greatly enlarged outline, taken generally as a cross sectional elevation, of the outer contour of the embodiment of FIGS. 6 and 7 taken substantially as shown by section line 11—11 of FIG. 7.
Figure 12:
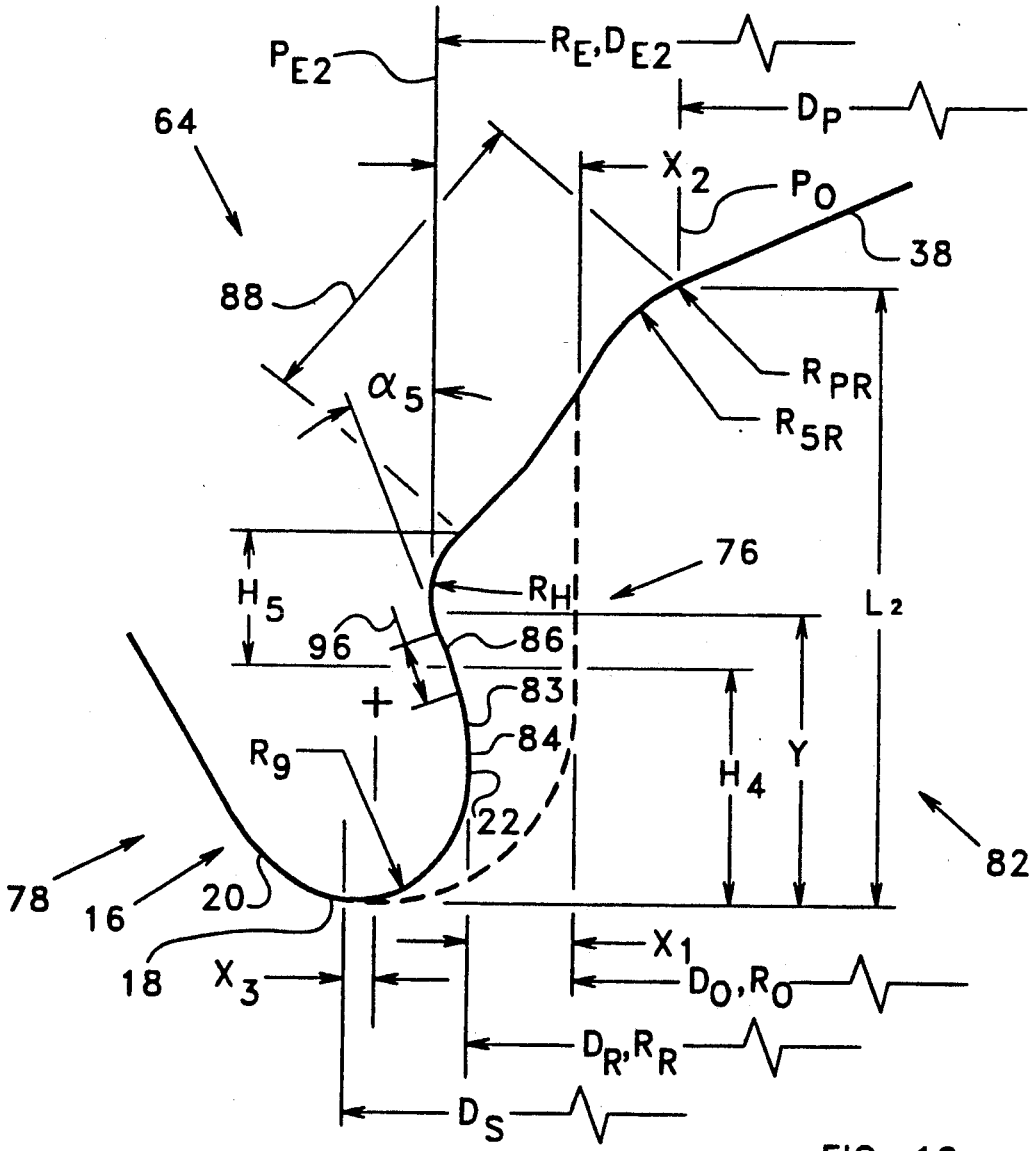
FIG. 12 is a fragmentary and greatly enlarged outline, taken generally as a cross sectional elevation, of the outer contour of the embodiment of FIGS. 8 and 9 taken substantially as shown by section line 12—12 of FIG. 9.

Referring now generally to FIGS. 6-12, containers 10 made generally according to the prior art configuration of FIGS. 3-5 can be reworked into containers 62 of FIGS. 6, 7, 10, and 11, or can be reworked into containers 64 of FIGS. 8, 9, and 12.

Referring now to FIGS. 6, 7, 10, and 11, the container 62 includes a cylindrical sidewall 12 and a bottom 66 having an annular supporting portion 16 with an annular supporting surface 18. The annular supporting surface 18 is disposed circumferentially around the vertical axis 14, and is provided at the circle of revolution 26 where the outer convex annular portion 20 and the inner convex annular portion 22 join.

The bottom 66 includes a bottom recess portion 68 that is disposed radially inwardly of the supporting surface 18 and that includes both the concave domed panel 38 and a dome positioning portion 70.

The dome positioning portion 70 disposes the concave domed panel 38 at the positional distance $L_2$ above the supporting surface 18. The dome positioning portion 70 includes the inner convex annular portion 22, an inner wall 71, and the inner concave annular portion 44.

Referring now to FIGS. 3-5, and more specially to FIG. 5, before reworking into either the container 62 or the container 64, the container 10 includes a dome positioning portion 54. The dome positioning portion 54 includes the inner convex annular portion 22, the inner wall 42, and the inner concave annular portion 44.

Referring now to FIGS. 10 and 11, fragmentary and enlarged profiles of the outer surface contours of the container 62 of FIGS. 6 and 7 are shown. That is, the inner surface contours of the container 62 are not shown.

The profile of FIG. 10 is taken substantially as shown by section line 10—10 of FIG. 7 and shows the contour of the bottom 66 of the container 62 in circumferential parts thereof in which the dome positioning portion 70 of the bottom recess portion 68 has not been reworked.

Referring again to FIGS. 6 and 7, the dome positioning portion 70 of the container 62 includes a plurality of first parts 72 that are arcuately disposed around the circumference of the dome positioning portion 70 at a radial distance $R_0$ from the vertical axis 14 as shown in FIG. 7. The radial distance $R_0$ is one half of the inside diameter $D_0$ of FIGS. 10 and 11. The inside diameter $D_0$ occurs at the junction of the inner convex annular portion 22 and the inner wall 71. That is, the inside diameter $D_0$ is defined by the radially inward part of the inner convex annular portion 22.

The dome positioning portion 70 also includes a plurality of circumferentially-spaced adjacent pats 74 that are arcuately disposed around the dome positioning portion 70, that are circumferentially spaced apart, that are disposed at a radial distance $R_R$ from the vertical axis 14 which is greater than the radial distance $R_0$, and that are interposed intermediate of respective ones of the plurality of first parts 72, as shown in FIG. 7. The radial distance $R_R$ of FIG. 7 is equal to the sum of one half of the inside diameter $D_0$ and a radial distance $X_1$ of FIG. 11.

In a preferred configuration of the FIGS. 6 and 7 embodiment, the adjacent parts 74 are 5 in number, each have a full radial displacement for an arcuate angle $\alpha_4$ of 30 degrees, and each have a total length $L_3$ of 0.730 inches.

Referring again to FIG. 10, in circumferential parts of the container 62 of FIGS. 6 and 7 wherein the dome positioning portion 70 is not reworked, the mean diameter $D_3$ of the annular supporting portion 16 is 2.000 inches; and the inside diameter $D_0$ of the bottom recess portion 68 is 1.900 inches which is the minimum diameter of the inner convex annular portion 22. A radius $R_7$ of the outer contour of the outer convex annular portion 20 is 0.052 inches; and an outer radius $R_8$ of the inner convex annular portion 22 is 0.052 inches.

It should be noticed that the radii $R_7$ and $R_8$ are to the outside of the container 62 and are therefore larger than the radii $R_1$ and $R_2$ of FIG. 5 by the thickness of the material.

Referring now to FIG. 11, in circumferential parts of the FIGS. 6 and 7 embodiments wherein the dome positioning portion 70 is reworked, a radius $R_9$ of the inner convex annular portion 22 is reduced, the inside diameter $D_0$ is increased by the radial distance $X_1$ to the inside diameter $D_R$, a hooked part 76 of the dome positioning portion 70 is indented, or displaced radially outward, by a radial dimension $X_2$, and the arithmetical mean diameter $D_3$ of the supporting portion 16 is increased by a radial dimension $X_3$ from the diameter D3 of FIG. 10 to an arithmetical mean diameter $D_S$ of FIG. 11. The hooked part 76 is centered at a distance Y from the supporting surface 18 and includes a radius $R_H$.

Referring now to FIGS. 8, 9, and 12, the container 64 includes the cylindrical sidewall 12 and a bottom 78 having the annular supporting portion 16 with the supporting surface 18. A bottom recess portion 80 of the bottom 78 is disposed radially inwardly of the supporting surface 18 and includes both the concave domed panel 38 and a dome positioning portion 82.

The dome positioning portion 82 disposes the concave domed panel 38 at the positional distance $L_2$ above the supporting surface 18 as shown in FIG. 12. The dome positioning portion 82 includes the inner convex annular portion 22, an inner wall 83, and the inner concave annular portion 44 as shown and described in conjunction with FIGS. 3-5.

The dome positioning portion 82 of the container 64 includes a circumferential first part 84 that is disposed around the dome positioning portion 82 at the radial distance $R_R$ from the vertical axis 14 as shown in FIGS. 9 and 12. The radial distance $R_R$ is one half of the diameter $D_0$ of FIG. 12 plus the radial distance $X_1$. The diameter $D_0$ occurs at the junction of the inner convex annular portion 22 and the inner wall 42 of FIG. 5. That is, the diameter $D_0$ is defined by the radially inward part of the inner convex annular portion 22.

The dome positioning portion 82 also includes a circumferential adjacent part 86 that is disposed around the dome positioning portion 82, and that is disposed at an effective radius $R_E$ from the vertical axis 14 which is greater than the radial distance $R_R$ of the first part 84. The effective radius $R_E$ is equal to the sum of one half of the diameter $D_0$ and the radial dimension $X_2$ of FIG. 12. That is, the adjacent part 86 includes the hooked part 76; and the hooked part 76 is displaced from the radial distance $R_0$ by the radial dimension $X_2$. Therefore, it is proper to say that the adjacent part 86 is disposed radially outwardly of the first part 84.

Referring again to FIG. 10, prior to reworking, the mean diameter $D_3$ of the annular supporting portion 16 of the container 64 is 2.000 inches; the inside diameter $D_0$ of the bottom recess portion 68 is 1.900 inches, which is the minimum diameter of the inner convex annular portion 22; and the radii $R_7$ and $R_8$ of the outer and inner convex annular portions, 20 and 22, are 0.052 inches.

Referring now to FIG. 12, the radius $R_9$ of the inner convex annular portion 22 is reduced, the diameter $D_0$ is increased by the radial distance $X_1$ to the diameter $D_R$, a hooked part 76 of the dome positioning portion 82 is indented, or displaced radially outward, by the radial dimension $X_2$, and the arithmetical mean diameter $D_3$ of both the supporting portion 16 and the supporting surface 18 of FIG. 10 are increased by the radial dimension $X_3$ to the diameter $D_S$ of FIG. 12. The hooked part 76 is centered at the distance Y from the supporting surface 18 and includes the radius $R_H$.

Figure 13:
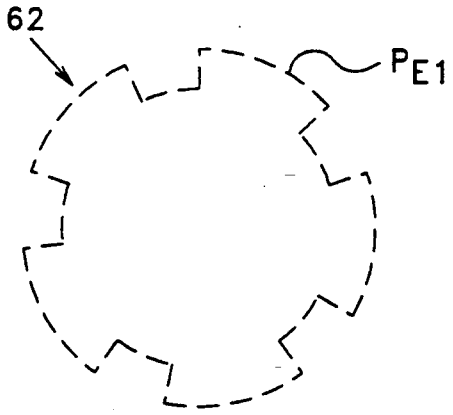
FIG. 13 is a fragmentary top view of the container of FIGS. 6, 7, 10, and 11, taken substantially as shown by view line 13—13 of FIG. 6, and showing the effectively increased perimeter of the embodiment of FIGS. 6 and 7.
Figure 14:
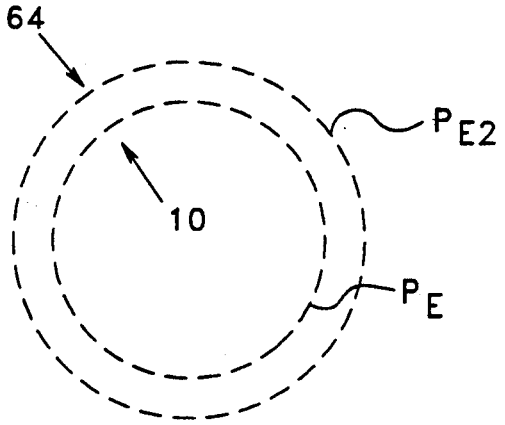
FIG. 14 is a fragmentary top view of the container of FIGS. 8, 9, and 12, taken substantially as shown by view line 14—14 of FIG. 8, and showing both the perimeter of the concave domed panel of the container of FIG. 5 and the effectively increased perimeter of the embodiment of FIGS. 8 and 9.

Referring now to FIGS. 5, 13, and 14, the concave domed panel 38 of the container 10 of FIG. 5 includes the perimeter $P_0$ and an unreworked effective perimeter $P_E$ that includes the inner concave annular portion 44.

However, when the container 10 is reworked into the container 62 of FIGS. 6 and 7, the domed panel 38 includes a reworked effective perimeter $P_{E1}$ which is larger than the perimeter $P_E$. In like manner, when the container 10 of FIG. 5 is reworked into the container 64 of FIGS. 8 and 9, the domed panel 38 includes a reworked effective perimeter $P_{E2}$ which is also larger than the unreworked effective perimeter $P_E$.

For testing, containers 10 made according to two different sets of dimensions, and conforming generally to the configuration of FIGS. 3-5, have been reworked into both containers 62 and 64.

Containers 10 made to one set of dimensions before reworking are designated herein as B6A containers, and containers 10 made according to the other set of dimensions are designated herein as Tampa containers. The B6A and the Tampa containers include many dimensions that are the same. Further, many of the dimensions of the B6A and Tampa containers and the same as a prior art configuration of the assignee of the present invention. Referring now to FIGS. 4, 5 and 10, prior to reworking, both the B6A containers and the Tampa containers included the following dimensions: $D_1=2.598$ inches; $D_2$, $D_3=2.000$ inches; $D_5=2.509$ inches; $R_3=0.200$ inches; $R_5=0.050$ inches; $R_6=0.200$ inches; $R_7$ and $R_8=0.052$; $H_2=0.370$ inches; $H_3=0.008$ inches; and $\alpha_2=30$ degrees. Other dimensions, including $R_4$, $H_1$, and the metal thickness are specified in Table 1.

The metal used for both the B6A and Tampa containers for tests reported herein was aluminum alloy which is designated as 3104 H19, and the test material was taken from production stock.

The dome radius $R_4$, as shown in Table 1, is the approximate dome radius of a container 10; and the dome radius $R_4$ is different from the radius $R_T$ of the domer tooling. More particularly, as shown in Table 1, tooling with a radius $R_T$ of 2.12 inches produces a container 10 with a radius $R_4$ of approximately 2.38 inches.

This difference in radius of curvature between the container and the tooling is true for the three Pulciani et al. patents, for the prior art embodiments of the assignee of the present invention, and also for the present invention.

Referring now to FIGS. 6, 8, and 10, the dome radius $R_4$ will have an actual dome radius $R_C$ proximal to the vertical axis 14, and a different actual dome radius $R_P$ at the perimeter $P_0$. Also, the radii $R_C$ and $R_P$ will vary in accordance with variations of other parameters, such as the height $L_1$ of the inner wall 71. Further, the dome radius $R_4$ will vary at various distances between the vertical axis 14 and the perimeter $P_0$.

The dome radius $R_C$ will be somewhat smaller than the dome radius $R_P$, because the perimeter $P_0$ of the concave domed panel 38 will spring outwardly. However, in the charts, the dome radius $R_4$ is given, and at the vertical axis 14, the dome radius $R_4$ is close to being equal to the actual dome radius $R_C$. When the containers 10 are reworked into the containers 62 and 64, as shown in FIGS. 6 and 8, the dome radii $R_C$ and $R_P$, as shown on FIG. 4, may or may not change slightly with containers 10 made to various parameters and reworked to various parameters. Changed radii, due to reworking of the dome positioning portions, 70 and 82, are designated actual dome radius $R_{CR}$ and actual dome radius $R_{PR}$ for radii near the vertical axis 14 and near the perimeter $P_0$, respectively. However, since the difference between the dome radii $R_C$ and $R_P$ is small, and since the dome radii $R_C$ and $R_P$ change only slightly during reworking, if at all, only the radius $R_4$ of FIG. 4 is used in the accompanying charts and in the following description.

Reworking of the dome positioning portions, 70 and 82, results in an increase in the radius $R_5$ of FIG. 5. To show this change in radius, the radius $R_5$, after reworking, is designated radius of curvature $R_{5R}$ in FIGS. 11 and 12 and in Table 1. As seen in Table 1, this change in the radius $R_5$ can be rather minimal, or quite large, depending upon various parameters in the original container 10 and/or in reworking parameters.

When the change in the radius $R_5$ of FIG. 5 is quite large, as shown for the Tampa container reworked into the container 64, reworking of the container 10 into the container 64 extends an effective diameter $D_E$ of the center panel 38, which includes the concave annular portion 44, and which is shown in FIG. 10, to an effective diameter $D_{E2}$, as shown in FIG. 12.

Therefore, in the reworking process, an annular portion 88 of the dome positioning portion 82, as shown in FIG. 12, is moved into, and affectively becomes a part of, the center panel 38.

Further, especially in the process in which the reworking is circumferential, as shown in FIGS. 8, 9, and 12, an annular portion 90, as shown in FIG. 10, of the bottom 78 which lies outside of the annular supporting surface 18, is moved radially inward, and effectively becomes a part of the dome positioning portion 82 of FIG. 12.

In Table 1, the static dome reversal pressure (S.D.R.) is in pounds per square inch, the cumulative drop height (C.D.H.) is in inches, and the internal pressure (I.P.) at which the cumulative drop height tests were run is in pounds per square inch.

The purpose for the cumulative drop height is to determine the cumulative drop height at which a filled can exhibits partial or total reversal of the domed panel.

The procedure is as follows: 1) warm the product in the containers to 90 degrees, plus or minus 2 degrees, Fahrenheit; 2) position the tube of the drop height tester to 5 degrees from vertical to achieve consistent container drops; 3) insert the container from the top of the tube, lower it to the 3 inch position, and support the container with a finger; 4) allow the container to free-fall and strike the steel base; 5) repeat the test at heights that successively increase by 3 inch increments; 6) feel the domed panel to check for any bulging or "reversal" of the domed panel before testing at the next height; 7) record the height at which dome reversal occurs; 8) calculate the cumulative drop height, that is, add each height at which a given container has been dropped, including the height at which dome reversal occurs; and 9) average the results from 10 containers.

A control was run on both B6A and Tampa containers prior to reworking into the containers 62 and 64. In this control testing, the B6A container had a static dome reversal pressure of 97 psi and the Tampa container had a static dome reversal pressure of 95 psi. Further, the B6A container had a cumulative drop height resistance of 9 inches and the Tampa container had a cumulative drop height resistance of 33 inches.

Referring now to Table 1, when B6A containers were reworked into the containers 62, which have a plurality of circumferentially-spaced adjacent parts 74 that are displaced radially outwardly, the static dome reversal pressure increased from 97 psi to 111 psi, and the cumulative drop height resistance increased from 9 inches to 10.8 inches.

TABLE 1

| | CONTAINER 62 INTERRUPTED ANNULAR INDENT | | CONTAINER 64 CONTINUOUS ANNULAR INDENT | |
|---|---|---|---|---|
| | B6A | TAMPA | B6A | TAMPA |
| $R_4$ | 2.38 | 2.038 | 2.38 | 2.038 |
| $R_T$ | 2.12 | 1.85 | 2.12 | 1.85 |
| $R_{5R}$ | — | — | 0.08 | 0.445 |
| $H_1$ | .385 | .415 | .385 | .415 |
| $D_R$ | 1.950 | 1.950 | 2.000 | 1.984 |
| $D_S$ | 2.020 | 2.020 | 2.051 | 2.041 |
| $R_H$ | .030 | .030 | .050 | .050 |
| $R_9$ | .030 | .030 | .026 | .026 |
| $X_1$ | .025 | .025 | .050 | .042 |
| $X_2$ | .054 | .051 | .055 | .055 |
| $X_3$ | .010 | .010 | .026 | .021 |
| Y | .084 | .086 | .076 | .092 |
| thkns. | .0116 | .0118 | .0116 | .0118 |
| I.P. | 58 | 59 | 58 | 59 |
| S.D.R. | 111 | 120 | 121 | 126 |
| C.D.H. | 10.8 | 30.0 | 18.0 | 60.0 |

When the Tampa containers were reworked into the containers 62, the static dome reversal pressure increased from 95 psi to 120 psi, and the cumulative drop height resistance decreased from 33 inches to 30 inches.

When the B6A containers were reworked into the containers 64, which have a circumferential adjacent part 86 that is displaced radially outwardly from a circumferential first part 84, the static dome reversal pressure increased from 97 psi to 121 psi, and the cumulative drop height resistance increased from 9 inches to 18 inches.

Finally, when the Tampa containers were reworked into the containers 64, the static dome reversal pressure increased from 95 psi to 126 psi, and the cumulative drop height resistance increased from 33 inches to 60 inches.

Thus, B6A and Tampa containers reworked into containers 62 of FIGS. 6 and 7 showed an improvement in static dome reversal pressure of 14.4 percent and 26.3 percent, respectively. B6A and Tampa containers reworked into containers 62 showed an improvement in cumulative drop height resistance of 20 percent in the case of the B6A container, but showed a decrease of 10 percent in the case of the Tampa container.

Further, B6A and Tampa containers reworked into containers 64 of FIGS. 8 and 9 showed an improvement in static dome reversal pressure of 24.7 percent and 32.6 percent, respectively. B6A and Tampa containers reworked into containers 64 showed an improvement in cumulative drop height resistance of 100 percent in the case of the B6A container, and an increase of 81.8 percent in the case of the Tampa container.

Therefore, the present invention provides phenomenal increases in both static dome reversal pressure and cumulative drop height without increasing the size of the container, without seriously decreasing the fluid volume of the container as would be caused by increasing the height $L_1$ of the inner wall, 71 or 83, or by greatly decreasing the dome radius $R_4$ of the concave domed panel 38, and without increasing the thickness of the metal.

While reworking the Tampa containers into the containers 62 did not show an increase in the cumulative drop height resistance, it is believed that this is due to two facts. One fact is that reworking of the containers 10 into the containers 62 and 64 was made without the benefit of adequate tooling. Therefore, the test samples were not in accordance with production quality. Another fact is that reworking the Tampa containers into the containers 64 resulted in a greater radial distance $X_1$ than did the reworking of the Tampa containers into the containers 62.

However, it remains a fact that reworking the B6A containers into the containers 64 did provide substantial increases in both the static dome reversal pressure and the cumulative drop height resistance.

It is believed that with further testing, parameters will be discovered which will provide additional increases in both static dome reversal pressure and cumulative drop height resistance.

Since the present invention provides a substantial increase in static dome reversal pressure, and with some parameters, a substantial increase in cumulative drop height resistance, it is believed that the present invention, when used with smaller dome radii $R_4$, or with center panel configurations other than spherical radii, will provide even greater combinations of static dome reversal pressures and cumulative drop height resistances than reported herein.

From general engineering knowledge, it is obvious that a dome radius $R_4$ that is too large would reduce the static dome reversal pressure. Further, it has been known that too small a dome radius $R_4$ would also reduce the static dome reversal pressure, even though a smaller dome radius $R_4$ should have increased the static dome reversal pressure.

While it is not known for a certainty, it appears that smaller values of dome radii $R_4$ placed forces on the inner wall 42 that were concentrated more directly downwardly against the inner convex annular portion 22, thereby causing roll-out of the inner convex annular portion 22 and failure of the container 10.

In contrast, a larger dome radius $R_4$ would tend to flatten when pressurized. That is, as a dome that was initially flatter would flatten further due to pressure, it would expand radially and place a force radially outward on the top of the inner wall 42, thereby tending to prevent roll-out of the inner convex annular portion 22.

However, a larger dome radius $R_4$ would have insufficient curvature to resist internal pressures, thereby resulting in dome reversal at pressures that are too low to meet beverage producers' requirements.

The present invention, by strengthening the inner wall 42 of the container 10 to the inner wall 71 of the container 62, or by strengthening the inner wall 83 of the container 64, increases in static dome reversal pressures that are achieved. These phenomenal increases in static dome reversal pressures are achieved by decreasing the force which tends to roll-out the inner convex annular portion 22.

More specifically, as seen in FIG. 12, in the instance of the container 64 where the adjacent part 86 of the dome positioning portion 82 is circumferential, an effective diameter $D_E$ of the concave domed panel 38 is increased. The container 64 also has an effective perimeter $P_2$ as shown in FIG. 14.

Or, as seen in FIG. 11 which shows circumferentially-spaced adjacent parts 74 that are displaced outwardly, an effective radius $R_E$ of the domed panel 38 is increased. An increase in the radius $R_E$ by the circumferentially-spaced adjacent parts 74 increases the effective perimeter $P_1$ of the domed panel 38 as shown in FIG. 13.

It can be seen by inspection of FIGS. 11 and 12 that placing the dome pressure force farther outwardly, as shown by the diameter $D_E$ and the radius $R_E$, reduces the moment arm of the roll-out force. That is, the ability of a given force to roll-out the inner convex annular portion 22 depends upon the distance, radially inward, where the dome pressure force is applied. Therefore, the increase in the effective diameter $D_E$ of the container 64, and the increase in the effective radius $R_E$, decrease the roll-out forces and thereby increase the resistance to roll-out.

Also, as shown in Table 1, the radius $R_9$ is reduced; and, from the preceding discussion, it can be seen that this reduction in radius also helps the containers 62 and 64 resist roll-out.

Continuing to refer to FIG. 12, the first part 84 of the container 64 is circumferential and might be considered to have a height $H_4$, and the adjacent part 86 is also circumferential and might be considered to have a height $H_5$. That is, defining the heights, $H_4$ and $H_5$, is somewhat arbitrary. However, as can be seen, the adjacent part 86 is disposed radially outward from the first part 84; and the hooked part 76 of the dome positioning portion 82 is formed with the radius $R_H$.

Thus, in effect, after reworking into a container 64, the dome positioning portion 82 is bowed outwardly at the distance Y from the supporting surface 18. This bowing outwardly of the dome positioning portion 82 is believed to provide a part of the phenomenal increase in static dome reversal pressure. That is, as the concave domed panel 38 applies a pressure-caused force downwardly, the outwardly-bowed dome positioning portion 82 tends to buckle outwardly, elastically and/or both elastically and plastically.

As the dome positioning portion 82 tends to buckle outwardly, it places a roll-in force on the inner convex annular portion 22, thereby increasing the roll-out resistance.

That is, whereas the downward force of the concave domed panel 38 presses downwardly tending to unroll both the outer convex annular portion 20 and the inner convex annular portion 22, the elastic and/or elastic and plastic buckling of the dome positioning portion 82 tends to roll up the convex annular portions, 20 and 22.

In like manner, as shown in FIG. 11, in circumferential portions of the container 62 which include the adjacent parts 74 and the hooked parts 76, the tendency of the dome positioning portion 70 to buckle outwardly is similar to that described for the dome positioning portion 82. However, since the hooked part 76 exists only in those circumferential parts of the dome positioning portion 70 wherein the adjacent parts 74 are located, the roll-in effect is not as great as in the container 64.

In summary, as shown and described herein, the present invention provides containers, 62 and 64, in which improvements in roll-out resistance, static dome reversal pressure, and cumulative drop height are all achieved without increasing the metal thickness, without decreasing the dome radius $R_4$, without increasing the positional distance $L_2$, without increasing the dome height $H_1$, and without appreciably decreasing the fluid capacity of the containers, 62 and 64. Or, conversely, the present invention provides containers, 62 and 64, in which satisfactory values of roll-out resistance, static dome reversal pressure, and cumulative drop height can be achieved using metal of a thinner gauge than has heretofore been possible.

It is believed that the present invention yields unexpected results. Whereas, in prior art designs, a decrease in the dome radius $R_4$ has decreased the dome reversal pressure, in the present invention, a decrease in the dome radius $R_4$, combined with strengthening the dome positioning portion, 70 or 82, achieves a remarkable increase in both dome reversal pressure and cumulative drop height resistance.

Further, the fact that phenomenal increases in both cumulative drop height resistance and static dome reversal pressures have been achieved by simply reworking a container of standard dimensions is believed to constitute unexpected results.

When referring to dome radii $R_4$, or to limits thereof, it should be understood that, while the concave domed panels 38 of containers 62 and 64 have been made with tooling having a spherical radius, both the spring-back of the concave domed panel 38 of the container 10, and reworking of the container 10 into containers 62 and 64, change the dome radius from a true spherical radius.

Therefore, in the claims, a specified radius, or a range of radii for the radius, $R_4$ would apply to either a central portion 92 or to an annular portion 94, both of FIGS. 6 and 8.

The central portion 92 has a diameter $D_{CP}$ which may be any percentage of the diameter $D_P$ of the concave domed panel 38; and the annular portion 94 may be disposed at any distance from the vertical axis 14 and may have a radial width $X_4$ of any percentage of the diameter $D_P$ of the concave domed panel 38.

Further, while the preceding discussion has focused on center panels 38 with radii $R_4$ that are generally spherical, and that are made with spherical tooling, the present invention is applicable to containers, 62 or 64, in which the concave domed panels 38 are ellipsoidal, consist of annular steps, decrease in radius of curvature as a function of the distance radially outward of the concave domed panel 38 from the vertical axis 14, have some portion 92 or 94 that is substantially spherical, include a portion that is substantially conical, and/or include a portion that is substantially flat.

Finally, while the limits pertaining to the shape of the center panel 38 may be defined as functions of dome radii $R_4$, limits pertaining to the shape of the center panel 38 can be defined as limits for the central portion 92 or for the annular portion 94 of the center panel 38, or as limits for the angle $\alpha_3$, whether at the perimeter $P_0$, or at any other radial distance from the vertical axis 14.

Referring finally to FIGS. 5–12, another distinctive difference in the present invention is in the slope of the inner walls, 71 and 83, of containers 62 and 64, respectively. As seen in FIG. 5, the inner wall 42 of the prior art slopes upwardly and inwardly by the angle $\alpha_1$.

In stark contrast to the prior art, the inner wall 83 of the container 64 of FIGS. 8, 9, and 12 includes a negatively-sloping part 96 that slopes upwardly and outwardly at a negative angle $\alpha_5$. As seen in FIG. 9, the negatively-sloping part 96 extends circumferentially around the vertical axis 14.

Also in stark contrast to the prior art, the inner wall 71 of the container 62 of FIGS. 6, 7, and 11 includes a negatively-sloping part 98 that slopes upwardly and outwardly by a negative angle $\alpha_6$, and that is disposed arcuately around less than one-half of the bottom 66 of the container 62. The inner wall 71 also includes another negatively-sloping part 100 that slopes upwardly and outwardly at the negative angle $\alpha_6$, and that is spaced circumferentially from the negatively-sloping part 98.

Therefore, in the appended claims, center panel should be understood to be without limitation to a particular, or a single, geometrical shape.

In summary, the present invention provides these remarkable and unexpected improvements by means and method as recited in the aspects of the invention which are included herein.

Although aluminum containers have been investigated, it is believed that the same principle, namely increasing the roll-out resistance of the inner wall, from the inner wall 42 of the container 10 to either the inner wall 71 of container 62 or the inner wall 83 of the container 64, would be effective to increase the strength of containers made from other materials, including ferrous and nonferrous metals, plastic and other nonmetallic materials.

Figure 2:
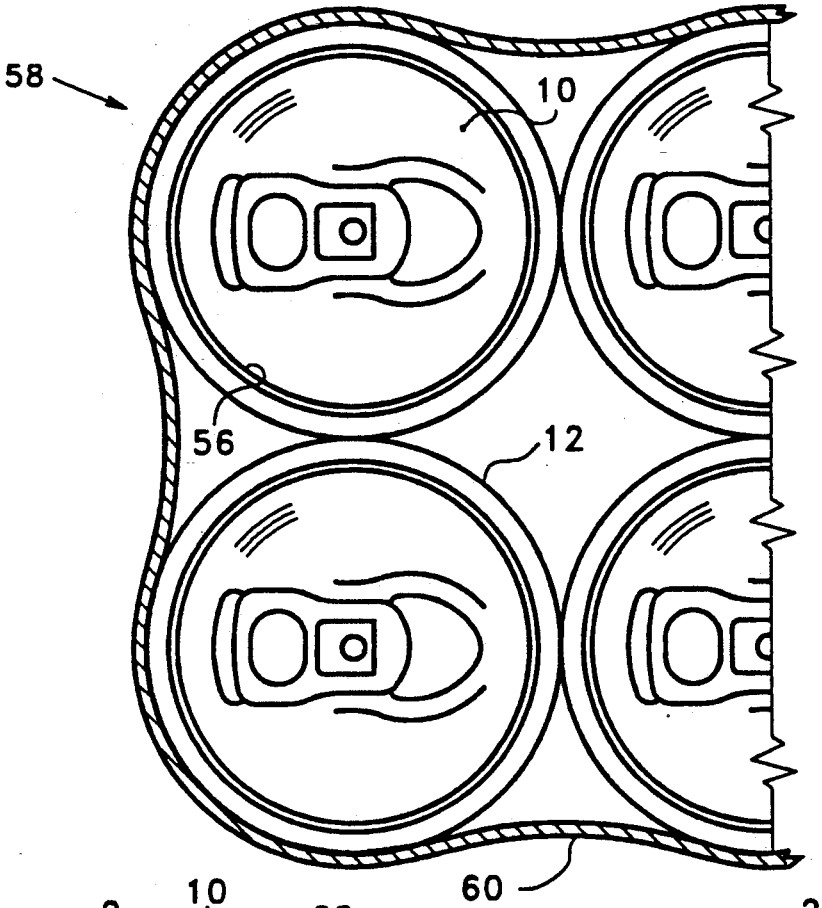
FIG. 2 is a top view of the bundled beverage containers of FIG. 1 taken substantially as shown by view line 2—2 of FIG. 1.
Figure 1:
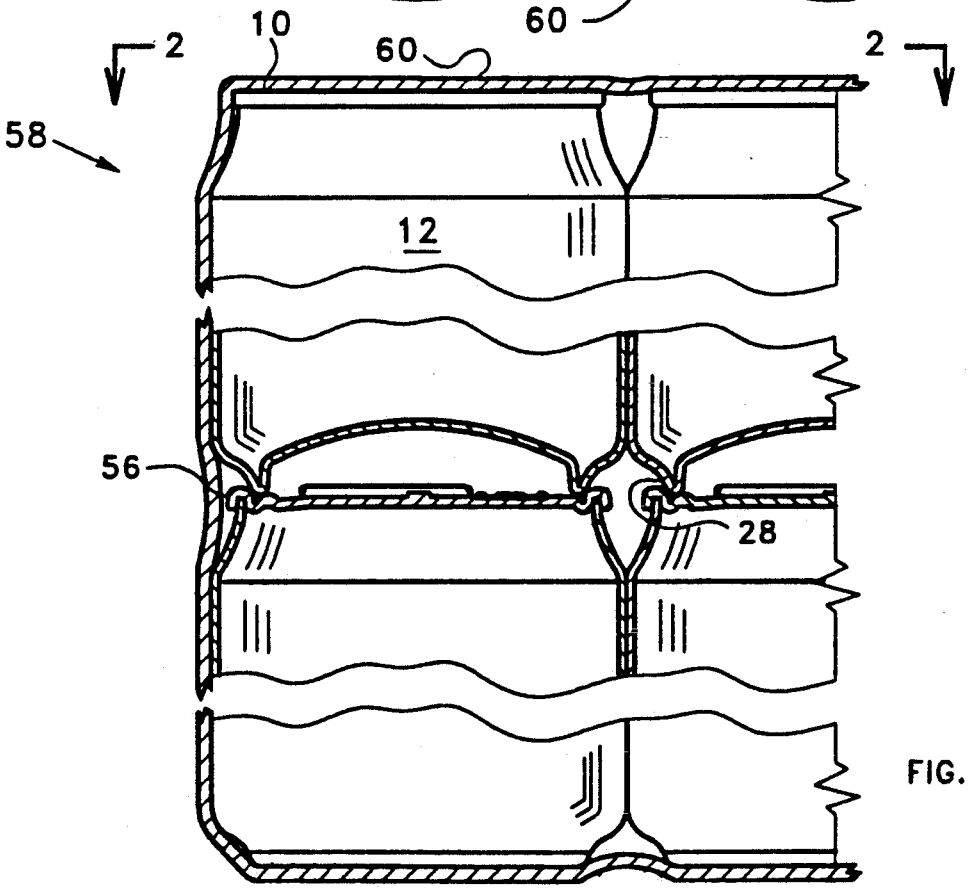
FIG. 1 is a front elevation of beverage containers that are bundled by shrink wrapping with plastic film.

Referring finally to FIGS. 1 and 2, upper ones of the containers 10 stack onto lower ones of the containers 10 with the outer connecting portions 28 of the upper ones of the containers 10 nested inside double-seamed tops 56 of lower ones of the containers 10; and both adjacently disposed and vertically stacked containers 10 are bundled into a package 58 by the use of a shrink-wrap plastic 60.

While this method of packaging is more economical than the previous method of boxing, possible damage due to rough handling becomes a problem, so that the requirements for cumulative drop resistances of the containers 10 is more stringent. It is this problem that the present invention addresses and solves.

While specific methods and apparatus have been disclosed in the preceding description, it should be understood that these specifics have been given for the purpose of disclosing the principles of the present invention and that many variations thereof will become apparent to those who are versed in the art. Therefore, the scope of the present invention is to be determined by the appended claims.

INDUSTRIAL APPLICABILITY

The present invention is applicable to containers made of aluminum and various other materials. More particularly, the present invention is applicable to beverage containers of the type having a seamless, drawn and ironed, cylindrically-shaped body, and an integral bottom with an annular supporting portion.

What is claimed is:

1. A drawn and ironed, thin-walled beverage container with improved strength, said container having an internal containment space, which comprises:

an outer wall being disposed around a vertical axis;

a bottom being integrally attached to said outer wall and having a supporting surface, wherein said outer wall and said bottom are of a one-piece construction; and a bottom recess portion of said bottom being disposed radially inwardly of said supporting surface, having a dome positioning portion that connects said bottom recess portion to the remainder of said bottom, and having a center domed panel that is disposed above said supporting surface by said dome positioning portion, wherein said center domed panel has an upwardly extending outer portion and wherein the remainder of said center domed panel is disposed at least as upward as a top end of said outer portion;

said dome positioning portion further comprising:

a first part disposed inwardly and upwardly relative to said supporting surface; and a second part, positioned above said first part, disposed outwardly and upwardly relative to said first part, and connected to said outer portion of said center domed panel, said outer portion being disposed upwardly and inwardly relative to said second part;

wherein said outer wall, said first part, said second part, and said outer portion substantially define a portion of said internal containment space.

2. A container, as claimed in claim 1, wherein at least a portion of said first and second parts of said dome positioning portion are disposed at different radial distances from said vertical axis.

3. A container as claimed in claim 1, wherein said first part of said dome positioning portion is substantially circumferential and wherein at least a portion of said first part is disposed at a first radial distance from said vertical axis, and wherein said second part of said dome positioning portion is substantially circumferential and wherein at least a portion of said second part is disposed at a different radial distance from said vertical axis than said portion of said first part.

4. A container as claimed in claim 1, wherein said first part of said dome positioning portion is substantially circumferential and is disposed at a first radial distance from said vertical axis and at a first distance from said supporting surface, and wherein said second part of said dome positioning portion is substantially circumferential and is disposed at a greater distance from said supporting surface and at a greater radial distance from said vertical axis than said first part.

5. A container as claimed in claim 1, wherein at least a portion of said first part of said dome positioning portion is disposed at a first radial distance from said vertical axis, and wherein a plurality of said second parts of said dome positioning portion are circumferentially spaced around said dome positioning portion and wherein at least a portion of each said second part is disposed at a different radial distance from said vertical axis than said portion of said first part.

6. A container as claimed in claim 1, wherein said first part of said dome positioning portion is disposed at a first distance from said supporting surface and at a first radial distance from said vertical axis and wherein a plurality of said second parts of said dome positioning portion are circumferentially spaced around said dome positioning portion and are disposed at a greater distance from said supporting surface and at a greater distance from said vertical axis than said first part.

7. A container as claimed in claim 1, wherein said first part of said dome positioning portion is disposed at a first radial distance from said vertical axis and at a first distance from said supporting surface and wherein said second part of said dome positioning portion is disposed at a greater distance from said supporting surface and at a greater radial distance from said vertical axis than said first part.

8. A drawn and ironed, thin-walled beverage container with an internal containment space and with increased resistance strength which comprises an outer wall that is disposed around a vertical axis, a bottom that is integrally attached to said outer wall and that provides a supporting surface, said outer wall and said bottom being of a one-piece construction, and a bottom recess portion that is disposed radially inwardly of said supporting surface, and that includes a center domed panel, said center domed panel having an upwardly extending outer portion with the remainder of said center domed panel being disposed at least as upward as a top end of said outer portion, the improvement which comprises:

said bottom recess portion including a first part that is disposed at a first vertical distance above said supporting surface and at a first radial distance from said vertical axis; and said bottom recess portion including an adjacent part that is disposed between said first part and said center domed panel, said adjacent part having at least a first portion disposed at a greater radial distance from said vertical axis than said first part and connected to said outer portion of said center domed panel, said outer portion extending upwardly and inwardly relative to said first portion;

wherein said outer wall, said first part, said adjacent part, and said outer portion substantially define a portion of said internal containment space.

9. An apparatus, as claimed in claim 8, wherein said first portion extends substantially about said vertical axis.

10. An apparatus, as claimed in claim 8, wherein said adjacent part further comprises at least a second portion disposed at a lesser radial distance from said vertical axis than said first portion.

11. An apparatus, as claimed in claim 10, wherein a plurality of said first portions are circumferentially spaced about said vertical axis and said second portion is positioned between each adjacent said first portions.

12. A drawn and ironed, thin-walled beverage container with increased strength, said container having an internal containment space, which comprises:

an outer wall that is disposed around a vertical axis;

a bottom that is integrally attached to said outer wall and that provides a supporting surface, wherein said outer wall and said bottom are of a one-piece construction; and a bottom recess portion that is disposed radially inwardly of said supporting surface and that includes a center domed panel, said center domed panel having an upwardly extending outer portion with the remainder of said center domed panel being disposed at least as upward as a top end of said outer portion;

said bottom recess portion further comprising:

a first part disposed at a first distance above said supporting surface, wherein said first part has a first portion disposed at a first radial distance from said vertical axis and a second portion disposed at a greater radial distance from said vertical axis than said first portion; and a second part, disposed at a greater distance above said supporting surface than said first part and at a greater radial distance from said vertical axis than said first and second portions of said first part, and connected to said outer portion of said center domed panel, said outer portion extending upwardly and inwardly relative to said second part;

wherein said outer wall, said first part, said second part, and said outer portion substantially define a portion of said internal containment space.

13. An apparatus, as claimed in claim 12, wherein said second part is positioned in the same vertical plane as said second portion of said first part.

14. A drawn and ironed, thin-walled beverage container with an internal containment space and with increased strength which comprises an outer wall that is disposed around a vertical axis, a bottom that is integrally attached to said outer wall and that provides a supporting surface, said outer wall and said bottom being of a one-piece construction, and a bottom recess portion that is disposed radially inwardly of said supporting surface and that includes a center domed panel, said center domed panel having an upwardly extending outer portion with the remainder of said center domed panel being disposed at least as upward as a top end of said outer portion, the improvement which comprises:

said bottom recess portion including a first part that is disposed substantially circumferentially around said bottom recess portion at a first vertical distance above said supporting surface, and that is disposed at a first radial distance from said vertical axis; and said bottom recess portion including an adjacent part that is disposed substantially around said bottom recess portion at a greater vertical distance above said supporting surface, that is disposed at a greater radial distance from said vertical axis than said first part, and that is connected to said outer portion of said center domed panel, said outer portion extending upwardly and inwardly relative to said adjacent part;

wherein said outer wall, said first part, said adjacent part, and said outer portion substantially define a portion of said internal containment space.

15. A drawn and ironed, thin-walled beverage container with improved strength, said container having an internal containment space, which comprises:

an outer wall being disposed around a vertical axis;

a bottom being integrally attached to said outer wall and having a supporting surface, wherein said outer wall and said bottom are of a one-piece construction;

a bottom recess portion of said bottom being disposed radially inwardly of said supporting surface, having a dome positioning portion with a convex annular portion that connects said bottom recess portion to the remainder of said bottom, and having a center domed panel that is disposed above said supporting surface by said dome positioning portion, wherein said center domed panel has an upwardly extending outer portion with the remainder of said center domed panel being disposed at least as upward as a top end of said outer portion; and a first part, positioned between said convex annular portion and said center domed panel, which is disposed radially outward from at least a portion of said convex annular portion and which is connected to said outer portion of said center domed panel, said outer portion extending upwardly and inwardly relative to said first part;

wherein said outer wall, said convex annular portion, said first part, and said outer portion substantially define a portion of said internal containment space.

16. A container as claimed in claim 15, wherein said first part is a substantially circumferential part of said bottom recess portion.

17. A container as claimed in claim 15, wherein there are a plurality of circumferentially spaced said first parts of said bottom recess portion.

18. A drawn and ironed, thin-walled beverage container with improved strength, said container having an internal containment space, which comprises:

an outer wall being disposed around a vertical axis;

a bottom being integrally attached to said outer wall, said outer wall and said bottom being of a one-piece construction, said bottom having an inner wall and having a center domed panel that is disposed upwardly by said inner wall, wherein said center domed panel has an upwardly extending outer portion with the remainder of said center domed panel being disposed at least as upward as a top end of said outer portion;

said inner wall comprising:

a first part, contiguous with said bottom, that slopes inwardly and upwardly relative to said bottom, wherein a portion of said first part is disposed at a first radial distance from said vertical axis;

a second part, interconnected with and above said first part, that slopes outwardly and upwardly relative to said first part, wherein a portion of said second part is disposed at a second radial distance from said vertical axis, said second radial distance being greater than said first radial distance; and a third part, interconnected with and above said second part and interconnected with said outer portion of said center domed panel, that slopes inwardly and upwardly relative to said second part, said outer portion extending inwardly and upwardly relative to said third part, wherein a portion of said third part is disposed at a third radial distance from said vertical axis, said third radial distance being less than said second radial distance;

wherein said outer wall, said first part, said second part, said third part, and said outer portion substantially define a portion of said internal containment space.

19. A container as claimed in claim 18 in which said second part of said inner wall is substantially circumferential.

* * * * *

US005105973B1

REEXAMINATION CERTIFICATE (3525th)

United States Patent [19] [11] B1 5,105,973

Jentzsch et al. [45] Certificate Issued Jun. 2, 1998

[54] BEVERAGE CONTAINER WITH IMPROVED BOTTOM STRENGTH

[75] Inventors: K. Reed Jentzsch, Arvada; Otis H. Willoughby, Boulder, both of Colo.

[73] Assignee: Ball Corporation, Muncie, Ind.

Reexamination Request:
No. 90/003,302, Jan. 10, 1994

Reexamination Certificate for:

| | |
|---|---|
| Patent No.: | **5,105,973** |
| Issued: | **Apr. 21, 1992** |
| Appl. No.: | **600,943** |
| Filed: | **Oct. 22, 1990** |

[51] Int. Cl.[6] ..... B65D 7/42
[52] U.S. Cl. ..... 220/606; 220/906
[58] Field of Search ..... 220/606, 604, 220/608, 609, 623, 624, 906

[56] References Cited

U.S. PATENT DOCUMENTS

| | | | |
|---|---|---|---|
| 2,158,312 | 5/1939 | Terrell | 113/48 |
| 3,349,956 | 10/1967 | Stephan | 220/97 |
| 3,693,828 | 9/1972 | Kneusel et al. | 220/66 |
| 3,730,383 | 5/1973 | Dunn et al. | 220/66 |
| 3,760,751 | 9/1973 | Dunn et al. | 113/120 |
| 3,904,069 | 9/1975 | Toukmanian | 220/65 |
| 3,942,673 | 3/1976 | Lyu et al. | 220/66 |
| 3,998,174 | 12/1976 | Saunders | 113/120 |
| 4,147,271 | 4/1979 | Yamaguchi | 220/70 |
| 4,289,014 | 9/1981 | Maeder et al. | 72/348 |
| 4,294,373 | 10/1981 | Miller et al. | 220/70 |
| 4,341,321 | 7/1982 | Gombas | 220/66 |
| 4,372,143 | 2/1983 | Elert et al. | 72/343 |
| 4,465,199 | 8/1984 | Aoki | 215/1 |
| 4,620,434 | 11/1986 | Pulciano et al. | 72/347 |
| 4,768,672 | 9/1988 | Pulciani et al. | 220/66 |
| 4,885,924 | 12/1989 | Claydon | 72/109 |

FOREIGN PATENT DOCUMENTS

| | | | |
|---|---|---|---|
| 0337500 A2 | 10/1989 | European Pat. Off. | |
| 1514970 | 6/1967 | France . | |
| 1345040 | 1/1974 | United Kingdom . | |
| WO 83/02577 | 8/1983 | WIPO . | |
| 9111275 | 8/1991 | WIPO | 72/94 |

*Primary Examiner*—Steven M. Pollard

[57] ABSTRACT

A container with improved strength includes a cylindrical sidewall that is disposed around a vertical axis, and a bottom. The bottom of the container provides a supporting surface and includes a bottom recess portion that is disposed radially inwardly of the supporting surface. The bottom recess portion includes a center panel, and a dome positioning portion that positions the center panel above the supporting surface. The dome positioning portion includes a first part that is disposed at a first radial distance from the vertical axis and adjacent part that is disposed at a different radial distance from the vertical axis. In the container, a plurality of the adjacent parts are arcuately disposed are circumferentially spaced around the dome positioning portion and are interspersed with a plurality of the first parts. In the container the adjacent part is disposed circumferentially around the dome positioning portion at one height from the supporting surface, and the first part is disposed circumferentially around the dome positioning portion at a different height from the supporting surface.

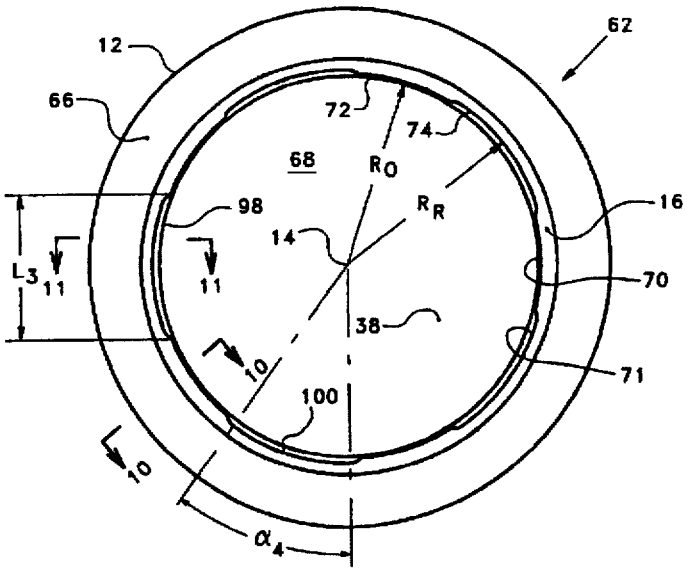

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–4, 7–10, 12–16, 18 and 19 are cancelled.

Claims 5, 6, 11 and 17 are determined to be patentable as amended.

5. A *drawn and ironed, thin-walled beverage* container [as claimed in claim 1, wherein at least a portion of said first part of said dome positioning portion is disposed at a first radial distance from said vertical axis, and] *with improved strength, said container having an internal containment space and being capable of receiving a beverage therein, which comprises;*

*an outer wall being disposed around a vertical axis;*

*a bottom being integrally attached to said outer wall and having a supporting surface, wherein said outer wall and said bottom are of a one-piece construction; and*

*a bottom recess portion of said bottom being disposed radially inwardly of said supporting surface, having a dome positioning portion that connects said bottom recess portion to the remainder of said bottom, and having a center domed panel that is disposed above said supporting surface by said dome positioning portion, wherein said center domed panel has an upwardly extending outer portion and wherein the remainder of said center domed panel is disposed at least as upward as a top end of said outer portion;*

*said dome positioning portion further comprising:*

*a first part disposed inwardly and upwardly relative to said supporting surface; and*

*a second part, positioned above said first part, disposed outwardly and upwardly relative to said first part, and connected to said outer portion of said center domed panel, said outer portion being disposed upwardly and inwardly relative to said second part;* wherein *said first and second parts are contained within a vertical reference plane, said container further comprising* a plurality of said *first and* second parts [of said dome positioning portion are] circumferentially spaced around said dome positioning portion [and wherein at least a portion of each said second part is disposed at a different radial distance from said vertical axis than said portion of said first part]; *and*

*wherein said outer wall, said first part, said second part, and said outer portion substantially define a portion of said internal containment space.*

6. A *drawn and ironed, thin-walled beverage* container [as claimed in claim 1,] *with improved strength, said container having an internal containment space, which comprises:*

*an outer wall being disposed around a vertical axis;*

*a bottom being integrally attached to said outer wall and having a supporting surface, wherein said outer wall and said bottom are of a one-piece construction; and*

*a bottom recess portion of said bottom being disposed radially inwardly of said supporting surface, having a dome positioning portion that connects said bottom recess portion to the remainder of said bottom, and having a center domed panel that is disposed above said supporting surface by said dome positioning portion, wherein said center domed panel has an upwardly extending outer portion and wherein the remainder of said center domed panel is disposed at least as upward as a top end of said outer portion;*

*said dome positioning portion further comprising:*

*a first part disposed inwardly and upwardly relative to said supporting surface; and*

*a second part, positioned above said first part, disposed outwardly and upwardly relative to said first part, and connected to said outer portion of said center domed panel, said outer portion being disposed upwardly and inwardly relative to said second part;* wherein said first part of said dome positioning portion [is disposed at a first distance from said supporting surface and at a first radial distance from said vertical axis and wherein] *extends upwardly relative to said supporting surface, said first and second part being substantially contained within a vertical reference plane, said container further comprising*:

a plurality of said *first and* second parts [of said dome positioning portion are] circumferentially spaced around said dome positioning portion [and are disposed at a greater distance from said supporting surface and at a greater distance from said vertical axis than said first part]; *and*

*wherein said outer wall, said first part, said second part, and said outer portion substantially define a portion of said internal containment space.*

11. [An apparatus, as claimed in claim 10,] *A drawn and ironed, thin-walled beverage container with an internal containment space, which is capable of receiving a beverage therein, and with increased resistance strength which comprises an outer wall that is disposed around a vertical axis, a bottom that is integrally attached to said outer wall and that provides a supporting surface, said outer wall and said bottom being of a one-piece construction, and a bottom recess portion that is disposed radially inwardly of said supporting surface, and that includes a center domed panel, said center domed panel having an upwardly extending outer portion with the remainder of said center domed panel being disposed at least as upward as a top end of said outer portion, the improvement which comprises:*

*said bottom recess portion including a first part that is disposed at a first vertical distance above said supporting surface and at a first radial distance from said vertical axis; and*

*said bottom recess portion including an adjacent part that is disposed between said first part and said center domed panel, said adjacent part having at least a first portion disposed at a greater radial distance from said vertical axis than said first part and connected to said outer portion of said center domed panel, said outer portion extending upwardly and inwardly relative to said first portion;*

*wherein said adjacent part further is annular and further comprises at least a second portion disposed at a lesser radial distance from said vertical axis than said first portion* wherein a plurality of said first portions are circumferentially spaced about said vertical axis and said second portion is positioned between each adjacent said first portions; *and*

*wherein said outer wall, said first part, said adjacent part, and said outer portion substantially define a portion of said internal containment space.*

17. A *drawn and ironed, thin-walled beverage* container [as claimed in claim 15.] *with improved strength, said container having an internal containment space and capable of receiving a beverage therein, which comprises:*

*an outer wall being disposed around a vertical axis;*

*a bottom being integrally attached to said outer wall and having a supporting surface, wherein said outer wall and said bottom are of a one-piece construction;*

*a bottom recess portion of said bottom being disposed radially inwardly of said supporting surface, having a dome positioning portion with a convex annular portion that connects said bottom recess portion to the remainder of said bottom, and having a center domed panel that is disposed above said supporting surface by said dome positioning portion, wherein said center*

*domed panel has an upwardly extending outer portion with the remainer of said center domed panel being disposed at least as upward as a top end of said outer portion;*

*a first part, positioned between said convex annular portion and said center domed panel, which is disposed radially outward from at least a portion of said convex annular portion and which is connected to said outer portion of said center domed panel, said outer portion extending upwardly and inwardly relative to said first part;* wherein there are a plurality of circumferentially spaced said first parts of said bottom recess portion; *and*

*wherein said outer wall, said convex annular portion, said first part, and said outer portion substantially devine a portion of said internal containment space.*

* * * * *